US008270871B2

(12) United States Patent
Murase et al.

(10) Patent No.: US 8,270,871 B2
(45) Date of Patent: Sep. 18, 2012

(54) ACCOMMODATING CONTAINER AND IMAGE FORMING APPARATUS USING THE SAME

(75) Inventors: Hirokazu Murase, Kanagawa (JP); Kei Hirata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 634 days.

(21) Appl. No.: 12/421,860

(22) Filed: Apr. 10, 2009

(65) Prior Publication Data

US 2010/0080644 A1 Apr. 1, 2010

(30) Foreign Application Priority Data

Sep. 26, 2008 (JP) ..... P2008-248926

(51) Int. Cl.
*G03G 15/08* (2006.01)

(52) U.S. Cl. ..... 399/106

(58) Field of Classification Search ..... 399/103, 399/105, 106, 262, 263; 222/DIG. 1
See application file for complete search history.

(56) References Cited

U.S. PATENT DOCUMENTS 5,812,915 A * 9/1998 Farkash ..... 399/262
5,870,652 A * 2/1999 Kanamori et al. ..... 399/106
5,878,307 A * 3/1999 Greenlaw et al. ..... 399/106
5,890,034 A * 3/1999 Nakano et al. ..... 399/106
7,155,138 B2 * 12/2006 Yamada ..... 399/106

FOREIGN PATENT DOCUMENTS

| | | |
|---|---|---|
| EP | 1 921 512 A2 | 5/2008 |
| JP | 10-149006 | 6/1998 |
| JP | 2000-010390 | 1/2000 |
| JP | 2003-015391 | 1/2003 |
| JP | 2003-57933 A | 2/2003 |
| JP | 2003-084553 | 3/2003 |
| JP | 2003-241497 A | 8/2003 |

* cited by examiner

*Primary Examiner* — Robert Beatty
(74) *Attorney, Agent, or Firm* — Morgan, Lewis & Bockius LLP

(57) ABSTRACT

An accommodating container includes: a container main body that has an opening at a part thereof; a cap member; and a seal member, wherein the seal member includes a plurality of seal abutment pieces that abut on a wall surface of the cap member or a wall surface of the container main body, and are elastically deformable, and at least one of the seal abutment pieces is arranged in non-contact with the wall surface of the cap member or the wall surface of the container main body in a first state before the cap member is attached to the container main body, and is arranged in contact with the wall surface of the cap member or the wall surface of the container main body in a second state where the cap member has been attached in an attachment position of the container main body.

19 Claims, 20 Drawing Sheets

ACCOMMODATING CONTAINER AND IMAGE FORMING APPARATUS USING THE SAME

CROSS-REFERENCE TO RELATED APPLICATIONS

This application is based on and claims priority under 35 U.S.C. 119 from Japanese Patent Application No. 2008-248926 filed Sep. 26, 2008.

BACKGROUND

Technical Field

The present invention relates to an accommodating container, and an image forming apparatus using the same.

SUMMARY

According to an aspect of the present invention, an accommodating container, which is detachably attached to a container receiver of an image forming apparatus housing and accommodates imaging material therein, the accommodating container including: a container main body that has an opening at a part of the container main body, and accommodates the imaging material; a cap member that is detachably attached to an opening edge of the container main body, and that is pushed into the container main body up to an attachment position; and a seal member that is held by the cap member or the container main body, and that, when the cap member has been attached in the attachment position of the container main body, fills between the opening edge and the cap member and provides a seal between the opening edge and the cap member, wherein the seal member includes a plurality of seal abutment pieces that abut on a wall surface of the cap member or a wall surface of the container main body, and are elastically deformable, and at least one of the seal abutment pieces is arranged in non-contact with the wall surface of the cap member or the wall surface of the container main body in a first state before the cap member is attached to the container main body, and is arranged in contact with the wall surface of the cap member or the wall surface of the container main body in a second state where the cap member has been attached in an attachment position of the container main body.

BRIEF DESCRIPTION OF THE DRAWINGS

Exemplary embodiment of the present invention will be described in detail based on the following figures, wherein.

DETAILED DESCRIPTION (Outline of Embodiment)

Figure 1A:
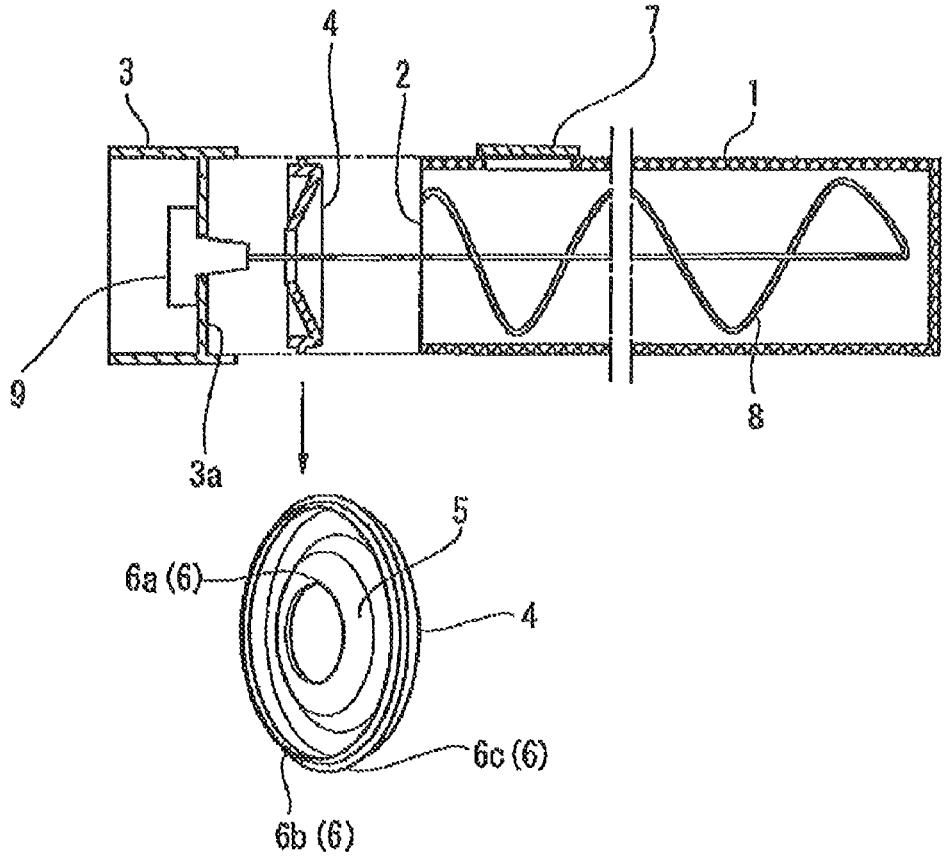
FIG. 1A is an explanatory view showing an outline of a developer accommodating container according to an embodiment to which the invention is applied.

FIG. 1A shows an outline of an embodiment of an accommodating container to which the invention is applied.

The accommodating container said herein includes widely containers which accommodate imaging material that is material for image formation. As an example of the containers, a developer accommodating container which accommodates developer used in an electrophotographic type as imaging material will be described below.

Further, such the developer accommodating container is detachably attached to a container receiving portion of an image forming apparatus housing, and works as a part for supplying the developer to an image forming apparatus.

In FIG. 1A, the developer accommodating container is detachably attached to the container receiving portion of the image forming apparatus housing, and accommodates the developer as the imaging material. The developer accommodating container includes a container main body 1 which has at its part an opening 2 and accommodates the developer therein; a cap member 3 which is detachably attached to an opening 2 edge of this container main body 1 and pushed onto the container main body 1 up to a predetermined attachment position; and a seal member 4 which is held by the cap member 3 or the container main body 1, fills between the opening 2 edge and the cap member 3 when the cap member 3 is attached in an attachment position S of the container main body 1, and provides a seal between them.

Figure 1B:
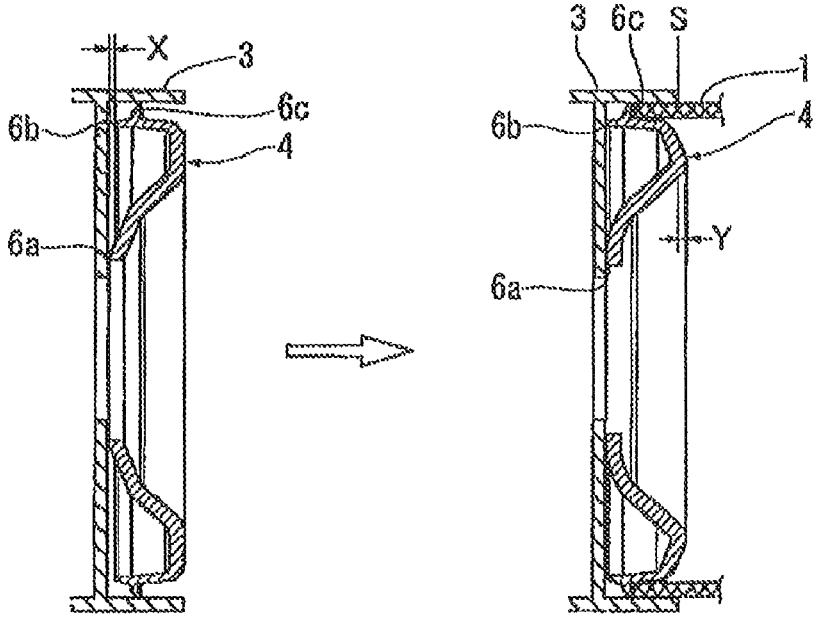
FIG. 1B is an explanatory view showing behavior of a seal member from a preassembly state to an assembly state.

In the embodiment, the seal member 4, as shown in FIGS. 1A and 1B, has plural seal abutment pieces 6 (for example, 6*a* to 6*c*) which abut on a wall surface of the cap member 3 (or container main body 1) on its held side and are elastically deformable. At least one (for example, 6*b*) of the plural seal abutment pieces 6, in a preassembly state before the cap member 3 is attached to the container main body 1, is arranged in non-contact with the wall surface of the cap member 3 (or container main body 1) on its held side, and, in an assembly state where the cap 3 is attached in the attachment position S of the container main body 1, is arranged in contact with the wall surface of the cap member 3 (or container main body 1) on its held side.

Further, in the embodiment, the seal member 4, as shown in FIGS. 1A and 1B, has plural seal abutment pieces 6 (for example, 6*a* to 6*c*) which abut on a wall surface of the cap member 3 (or container main body 1) on its held side and are elastically deformable. At least one (for example, 6*a*, 6*c*) of the plural seal abutment pieces 6, in either of a preassembly state before the cap member 3 is attached to the container main body 1 and an assembly state where the cap 3 is attached in the attachment position S of the container main body 1, is arranged in contact with the cap member 3 (or container main body 1) on its held side; and at least another piece (for example, 6*b*) of the plural seal abutment pieces 6, in the preassembly state of the cap member 3, is arranged in non-contact with the cap member 3 (or container main body 1) on its held side and, and, in the assembly state of the cap member 3, is arranged in contact with the cap member 3 (or container main body 1) on its held side.

In FIG. 1A, reference numeral 7 is an opening and closing mechanism which is provided at a part of the container main body 1 and used in order to supply developer in the container main body 1 to the image forming apparatus side when the developer accommodating container has been attached to the image forming apparatus housing, reference numeral 8 is a conveying member which rotates thereby to convey the developer in the container main body 1, and reference numeral 9 is a rotation coupling member which is attached to the cap member 3 and transmits a rotation driving force from an external drive source to the conveying member 8.

Thus, in the developer accommodating container according to the embodiment, between the preassembly state of the cap member 3 and the assembly state thereof, the sealing state by the seal abutment pieces 6 (6*a* to 6*c*) of the seal member 4 is different.

In such the developer accommodating container, the opening and closing operation of the cap member 3 may be a rotational operation type by means of a screw portion, or a linear advance and retreat operation type.

Further, in the embodiment, since the seal member 4 has the seal portion at least one spot thereof from a viewpoint of realizing the sealing function, the present invention is based on the assumption that there are the plural seal abutment pieces 6.

Further, the wall surface on which the seal abutment piece 6 abuts is not limited to the surface opposing to the push and pull direction of the cap member 3, but may be a surface along the push and pull direction of the cap member 3.

Furthermore, when the contact portions of the seal abutment pieces 6 with the surface opposing to the push and pull direction of the cap member 3 increase, the slide resistance when the rotation of the cap member 3 is operated can be increased. On the other hand, when the contact portions of the seal abutment pieces 6 with the surface along the push and pull direction of the cap member 3 increase, the slide resistance in either of the rotational operation of the cap member 3 and the push and pull operation thereof can be increased.

In a typical mode of the holding portion for the seal member 4, the cap member 3 has a bottomed fit portion 3*a* into which the opening 2 edge cylindrical portion of the container main body 1 is fitted, and the holding portion for the seal member 4 is formed at this fit portion 3*a*.

Further, in a typical mode of such the seal member 4, an annular main body portion 5 which is accommodated into the fit portion 3*a* of the cap member 3 and which a rotational shaft of the conveying member 8 penetrates is provided, and this annular main body portion 5 has seal abutment pieces 6 (for example, 6*a* to 6*c*) which abut on the bottom wall of the fit portion 3*a* that the rotational shaft of the conveying member 8 penetrates and on the peripheral wall surrounding the rotational shaft.

The rotational shaft of the conveying member 8 said herein includes not only the rotational shaft portion that is a component of the conveying member 8 itself but also the rotation coupling member 9 such as a coupling functioning substantially as a rotational shaft of the conveying member 8.

Further, in a preferable mode of the seal member 4, an annular main body portion 5 which is accommodated into the fit portion 3*a* of the cap member 3 and which a rotational shaft of the conveying member 8 penetrates is provided, seal abutment pieces 6 (for example, 6*a* and 6*b*) which abut on the bottom wall of the fit portion 3*a* are formed on the inner side and the outer side of the annular main body portion 5 viewed from the rotational shaft of the conveying member 8, and the seal abutment piece 6 (for example, 6*b*) located on the outer side or the inner side of the annular main body portion 5 is arranged in non-contact with the bottom wall of the fit portion 3*a* in the preassembly state before the cap member 3 is attached to the container main body 1.

Furthermore, in a preferable dimensional relation of the seal abutment piece 6, the seal member 4 has plural seal abutment pieces 6 (for example, 6*a* and 6*b*) extending in the pushing direction of the cap member 3, and a relation of $X<Y$ is satisfied, in which X is dimensional difference along the pushing direction of the cap member 3 between the plural seal abutment pieces 6 (for example, 6*a* and 6*b*) in the preassembly state before the cap member 3 is attached to the container main body 1, and Y is maximum elastic deformation volume of the seal member 4 along the pushing direction when the cap member 3 is in the assembly state where the cap member 3 is attached in the attachment position S of the container main body 1. This dimensional relation is necessary for the seal abutment piece 6 (6*b*) which was in non-contact in the preassembly state to abut on the wall surface in the elastic deformation state when the cap member 3 is put in the assembly state, and necessary to increase the slide resistance of the seal abutment piece 6 (6*b*) on its abutment surface.

On the basis of embodiments shown in attached drawings, this invention will be described more detailedly.

(First Embodiment)

(Entire Constitution of Image Forming Apparatus)

Figure 2:
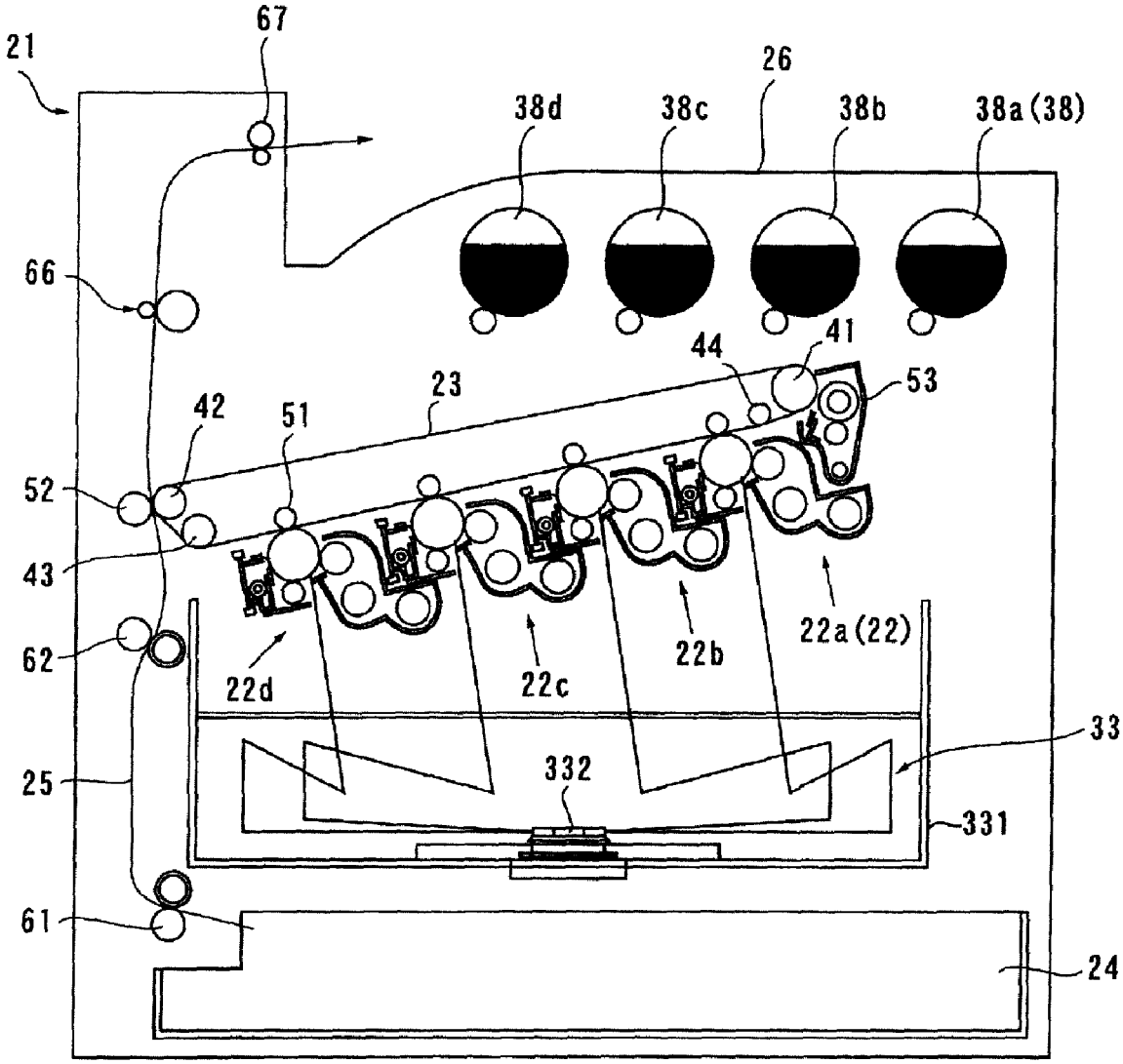
FIG. 2 is an explanatory view showing the whole constitution of an image forming apparatus according to a first embodiment to which the invention is applied.

FIG. 2 shows the entire constitution of an image forming apparatus in a first embodiment to which the invention is applied.

In FIG. 2, in the image forming apparatus, image forming sections 22 (specifically, 22*a* to 22*d*) for four colors (black, yellow, magenta, and cyan in the embodiment) are arranged in an image forming apparatus housing (hereinafter referred to as an apparatus housing) 21 in a lateral direction in a such positional relation that their sections 22 slightly slant toward the oblique upside, and an intermediate transfer belt 23 which is circularly conveyed along the arrangement direction of the respective image forming sections is disposed above the image forming sections 22. On the other hand, at the lower portion of the apparatus housing 21, a recording material supplying unit 24 in which recording materials are accommodated in a suppliable state is disposed; and at the upper portion of the apparatus housing 21, a recording material discharge receiver 26 onto which a recording material on which an image has been already formed is discharged and accommodated is provided, to which the recording material from the recording material supplying unit 24 is discharged through a recording material transport path 25 extending in the vertical direction.

Figure 3:
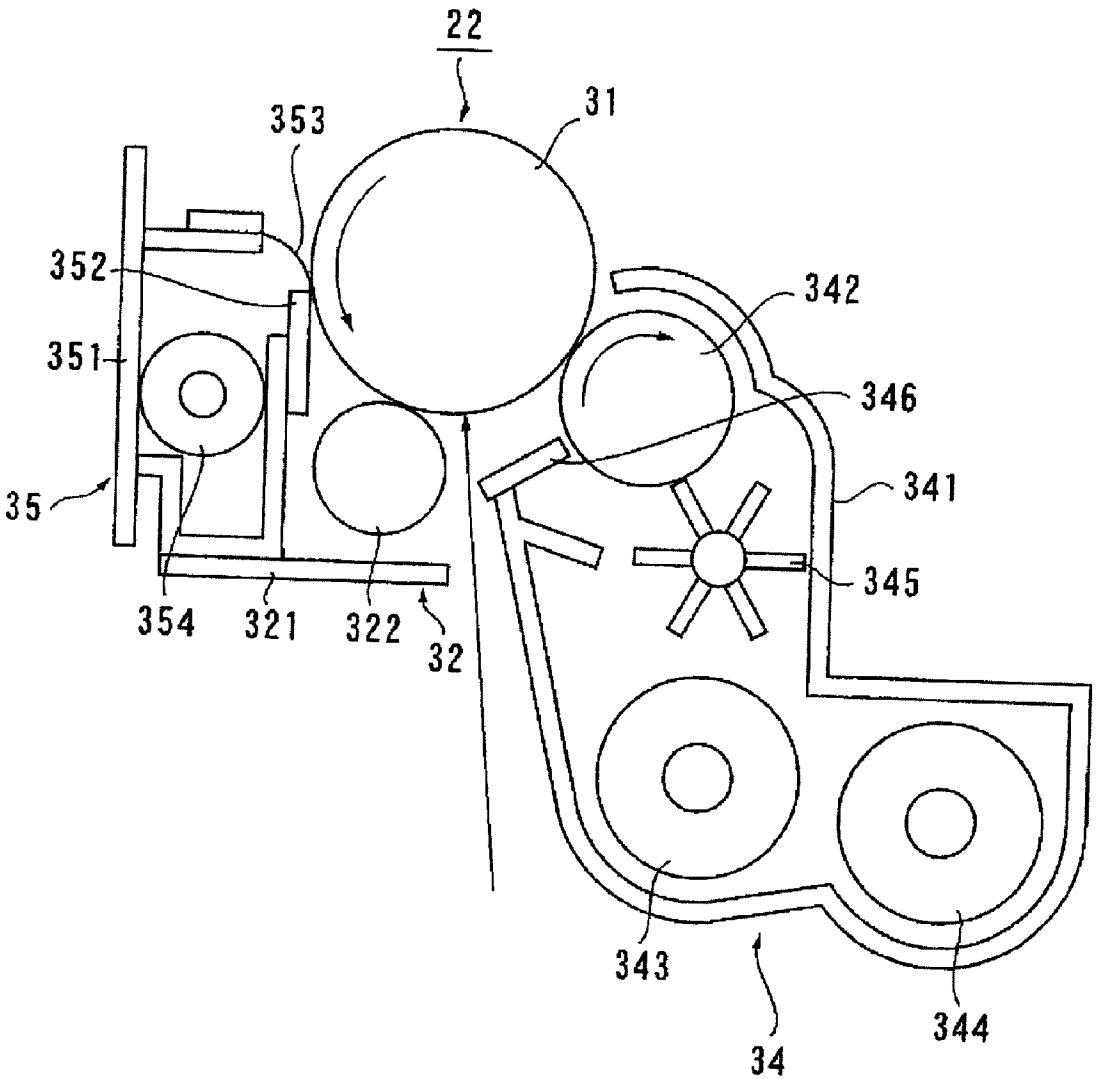
FIG. 3 is an explanatory view showing the details of an image forming section of the image forming apparatus shown in FIG. 2.

In the embodiment, the respective image forming sections 22 (22*a* to 22*d*), as shown in FIGS. 2 and 3, are used for forming toner images for black, yellow, magenta, and cyan in order from the upstream side in the circular direction of the intermediate transfer belt 23 (the arrangement of the sections 22 is always not limited to this order). Each image forming section 22 includes a photoconductor 31 formed in the shape of, for example, a drum, a charging unit 32 which previously charges this photoconductor 31, an exposure unit 33 which writes an electrostatic latent image onto the photoconductor 31 charged by this charging unit 32, a development unit 34 which makes the electrostatic latent image on the photoconductor 31 visible by each color toner, and a cleaning unit 35 which cleans residual toner on the photoconductor 31.

Here, the exposure unit 33 is used commonly in the respective image forming sections 22, which deflects and scans, in an exposure container 331, the light from a light source such as a semiconductor laser (not shown) of each color component, and guides an optical image through a not-shown imaging lens and a mirror to an exposure position on the corresponding photoconductor 31.

Further, the intermediate transfer belt 23 is laid on tension rolls 41 to 44, and circularly moves using, for example, the tension roll 41 as a drive roll. Further, a primary transfer unit 51 (for example, a primary transfer roll) is disposed on the back surface of the intermediate transfer belt corresponding to each photoconductor 31, and a voltage having the opposite polarity to the charge polarity of the toner is applied to this primary transfer unit 51, whereby the toner image on the photoconductor 31 is electrostatically transferred to the intermediate transfer belt 23 side.

Further, at an intermediate transfer belt 23 portion corresponding to the tension roll 42 on the downstream side of the image forming section 22*d* located on the most downstream side in the moving direction of the intermediate transfer belt 23, a secondary transfer unit 52 (for example, secondary transfer roll) is disposed, which transfers secondarily (in a lump) primary transfer images on the intermediate transfer belt 23 onto the recording medium.

Further, at an intermediate transfer belt 23 portion corresponding to the tension roll 41 located on the downstream side of the secondary transfer portion, an intermediate cleaning unit 53 is provided, which cleans residual toner on the intermediate transfer belt 23.

Here, a material in which an appropriate amount of antistatic agent such as carbon black is contained in resin such as polyimide, polycarbonate, polyester or polypropylene, or in each kind of rubber is used for the intermediate transfer belt 23, and the intermediate transfer belt 23 is formed so that volume resistivity becomes $10^6$~$10^{14}$ Ω·cm.

Further, in the embodiment, the recording material fed out by a feeder 61 of the recording material supplying unit 24 is transported by the appropriate number of transport rolls (not shown) in the recording material transport path 25, and position-adjusted by a registration roll 62. Thereafter, the recording material passes through the secondary transfer section of the secondary transfer unit 52, the unfixed toner image is fixed by, for example, heat-pressing in the fixing unit 66, and then the recording material is discharged and accommodated through a discharge roll 67 onto the recording material discharge receiver 26.

In FIG. 2, reference numeral 38 (38*a* to 38*d*) is a developer accommodating container (toner cartridge) for supplying new developer (toner in the embodiment) to the development unit 34 of each image forming section 22 (22*a* to 22*d*).

(Image Forming Section)

Particularly, in the embodiment, the photoconductor 31, as shown in FIG. 3, is constituted as a process cartridge which is integrated with the charging unit 32 and the cleaning unit 35, and this process cartridge is detachably attached to the apparatus housing 21 and constructs a part of the image forming section of each color component.

Here, the charging unit 32 has a charge container 321 whose portion opposing to the photoconductor 31 is opened, and a charge roll 322 which comes into contact with or comes close to the surface of the photoconductor 31 is arranged in this charge container 321.

Further, the cleaning unit 35 has a cleaning container 351 whose portion opposing to the photoconductor 31 is opened, a cleaning blade 352 composed of an elastic scraper plate which comes into contact with the photoconductor 31 is provided at one opening edge portion along the longitudinal direction of this cleaning container 351, an elastic seal material 353 which comes into contact with the photoconductor 31 is provided at the other opening edge portion along the longitudinal direction of this cleaning container 351, and a leveling transport member 354 which levels the residual substances such as toners scraped by the cleaning blade 352 along the longitudinal direction is disposed in the cleaning container 351.

Further, in the embodiment, the development unit 34 is attached to the apparatus housing 21 side separately from the process cartridge, and includes a developer container 341 which is opened so as to be opposite to the photoconductor 31 and accommodates developer containing at least toner. At an opening portion of this developer container 341, a developer bearing body 342 is disposed, which can transport the developer toward a development area located at the portion opposite to the photoconductor 31. On the back surface side of the developer bearing body 342 of this development container 341, a pair of developer agitation-transport members 343, 344 is disposed, which can agitate and transport the developer while the developer is circulating. Between the developer bearing body 342 and the developer agitation-transport member 343 located on this developer bearing body 342 side, a developer supplying member 345 is provided, which can supply the agitation-transported developer onto the developer bearing body 342 side. Further, the layer thickness of the developer supplied to the developer bearing body 342 is regulated to a predetermined layer thickness by a thickness regulating member 346, and thereafter the thickness-regulated developer is supplied to the development area.

(Developer Supply System)

Figure 4:
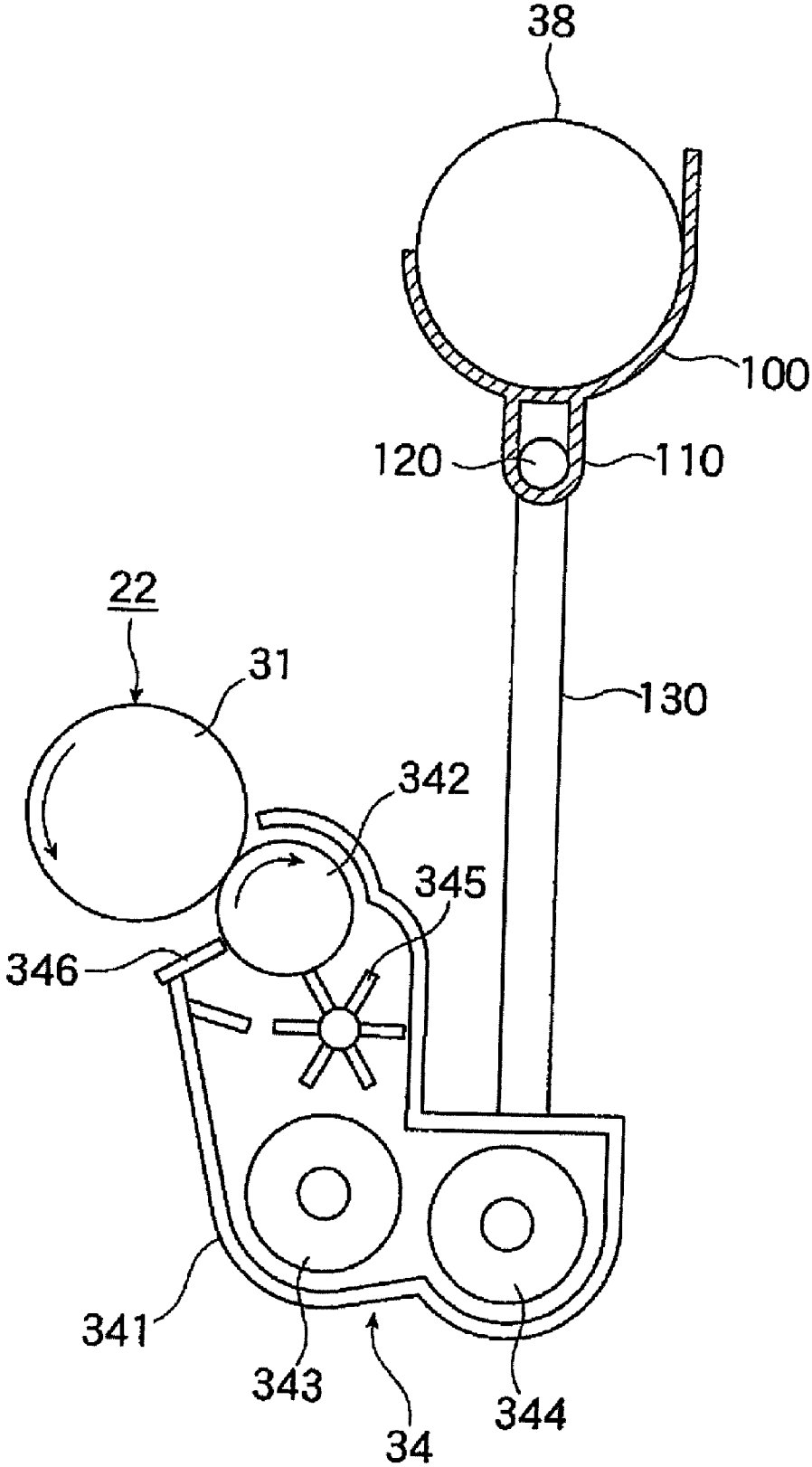
FIG. 4 is an explanatory view showing an example of a container receiver for a developer accommodating container used in the image forming apparatus shown in FIG. 2.

FIG. 4 shows an example of a developer supply system used in the embodiment.

In FIG. 4, the developer supply system includes a container receiver 100 formed at a part of the apparatus housing 21, to which the developer accommodating container 38 is attached in an insertable and pullable manner; a reserve tank 110 disposed under this container receiver 100, in which developer for replenishment is temporarily stored; a not-shown exit formed in the container receiver 100, from which the developer in the developer accommodating container 38 can be discharged when the developer accommodating container 38 is attached to the container receiver 100; a fixed-amount agitation-transport member 120 for supplying the fixed amount of developer from the reserve tank 110, which is disposed in the reserve tank 110; and a duct 130 which is coupled to a part of the reserve tank 110. Herein, on the basis of such density information that development density lowers, the predetermined amount of developer is replenished through the duct 130 into the development container 341 of the development unit 34.

(Developer Accommodating Container)

Figure 5:
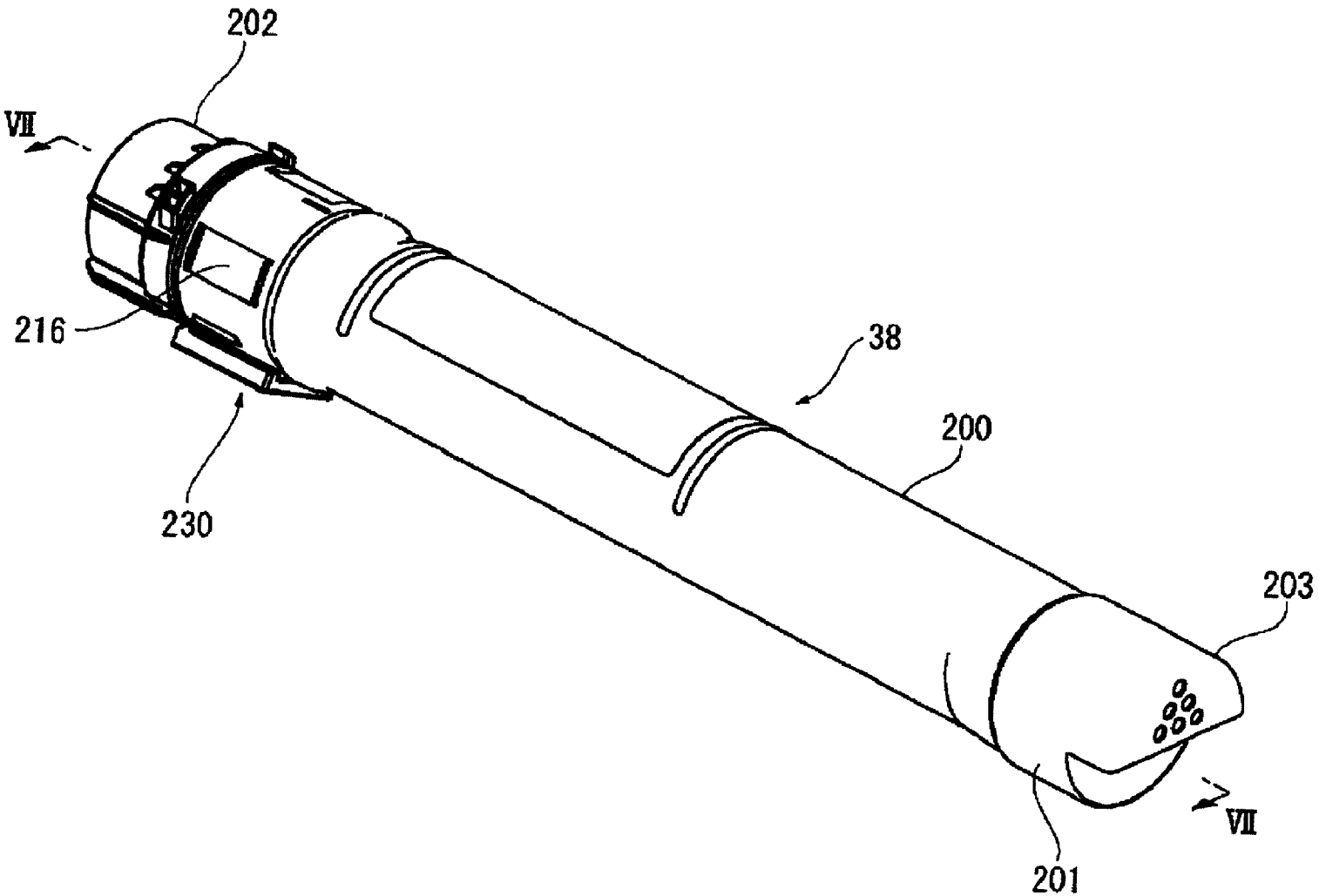
FIG. 5 is a perspective view showing the whole constitution of the developer accommodating container used in the first embodiment.
Figure 6:
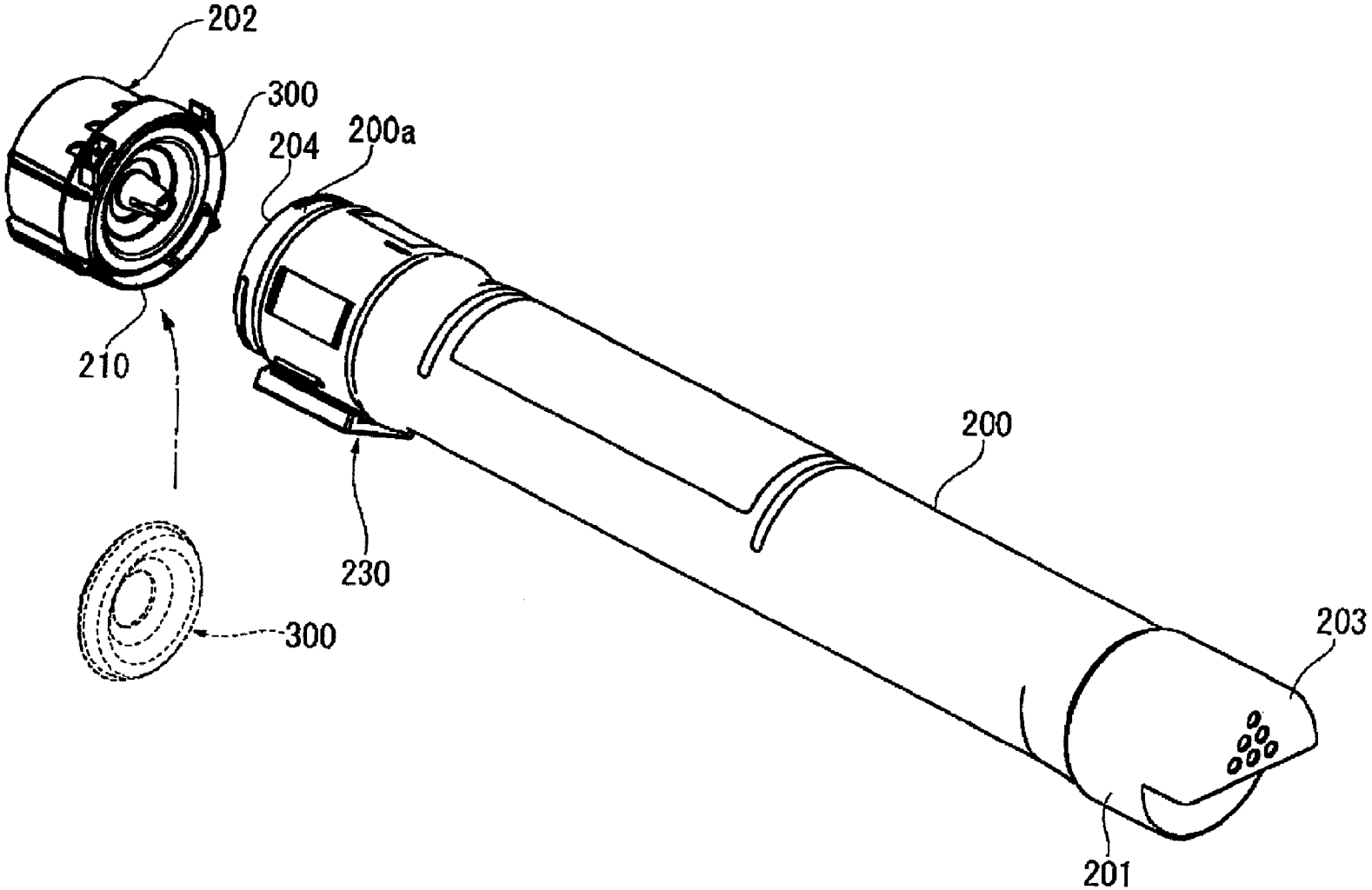
FIG. 6 is an explanatory view showing a state where a cap member is detached from the developer accommodating container shown in FIG. 5.
Figure 7:
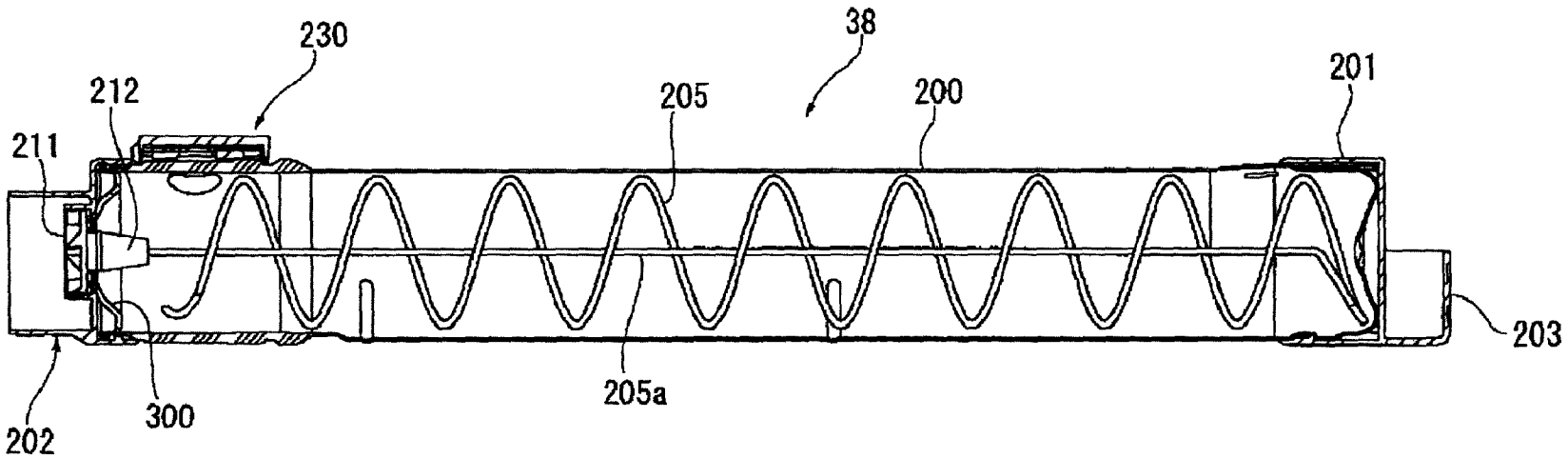
FIG. 7 is an explanatory view of a cross section taken along a line VII-VII in FIG. 5.

In the embodiment, the developer accommodating container 38 has, as shown in FIGS. 5 to 7, a long cylinder-shaped container main body 200 molded by stretching and blowing a synthetic resin such as ABS or PET, of which both ends are opened. In this container main body 200, an agitator 205 is disposed as a conveying member which can agitate the accommodated developer; and to both ends of the container main body 200, end flanges 201 and 202 are attached as cap members. In this example, an opening 204 capped by the end flange 202 of the cylindrical container main body 200 is utilized as a developer filling port from which the developer can be filled.

For one end flange 201, a grip handle 203 is provided.

Further, at the other end flange 202, as shown in FIGS. 5 to 9, a fit portion 210 composed of a bottomed concave portion is formed, into which a tip cylindrical portion 200*a* of the container main body 200 is detachably fitted. This fit portion 210 includes a bottom wall 213 which a rotational shaft of the agitator 205 penetrates, and a peripheral wall 214 which surrounds the periphery of the agitator 205. For the bottom wall 213 of the fit portion 210, a rotor 211 is provided, to which a drive shaft is coupled from a not-shown external drive source. In the inner surface center of this rotor 211, a hitch portion 212 is provided as a coupling member to which a rotational shaft portion 205*a* of the agitator 205 is hitched.

Figure 9:
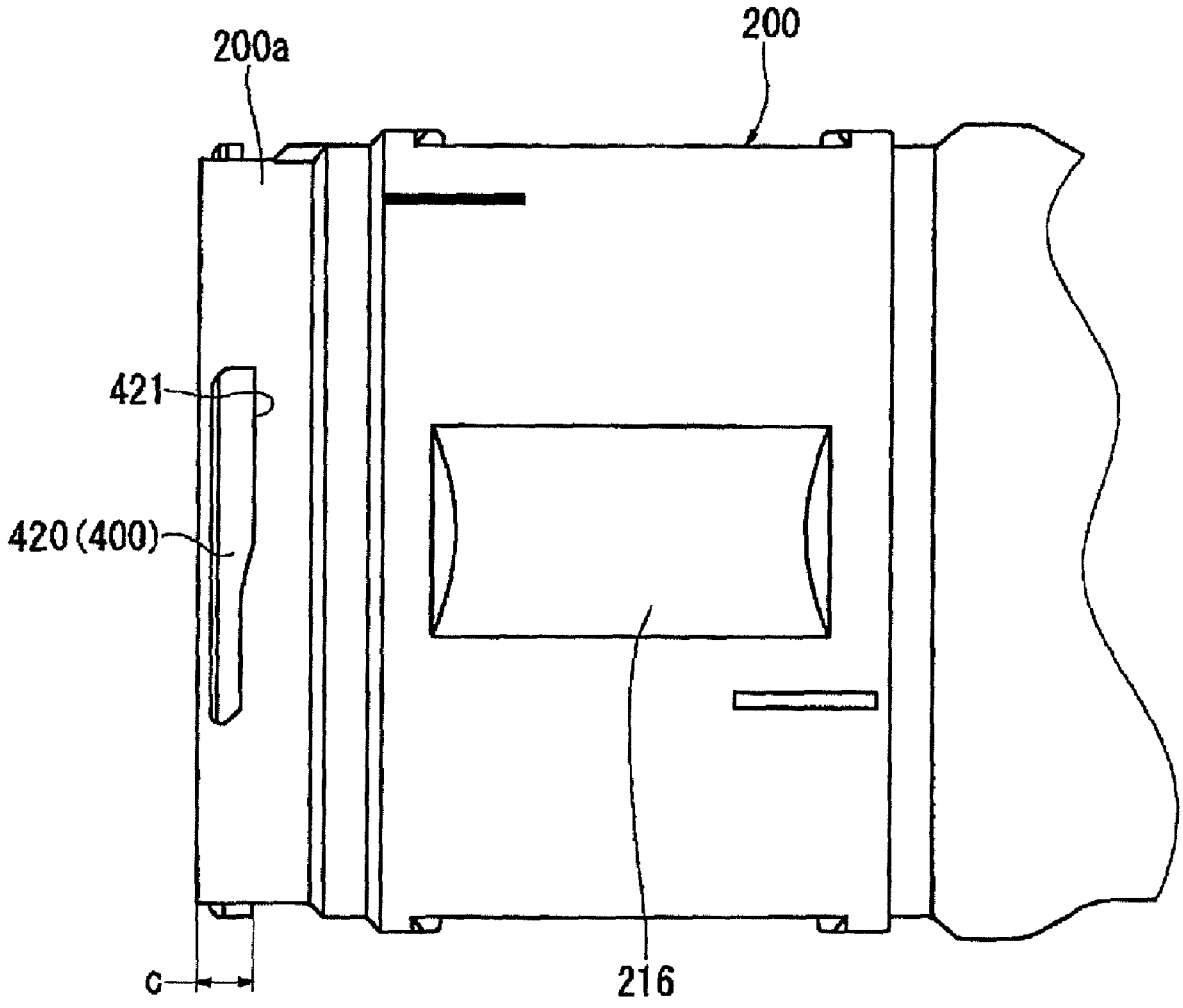
FIG. 9 is an explanatory view showing the details of an opening edge of a container main body used in the first embodiment.

In FIG. 9, reference numeral 216 is a nonvolatile memory as a usage history management memory, which is attached to an appropriate portion of the container main body 200. This memory 216, when the developer accommodating container 38 is attached to the container receiver 100, is communicably connected to a not-shown control unit, and the usage history of the developer accommodating container 38 is recorded in the memory 216.

(Seal Member)

Further, in the embodiment, between the end flange 202 and the container main body 200, a seal member 300 for providing a seal between them is provided.

This seal member 300, in a stage before the assembly state where the end flange 202 is attached to the container main body 200, is held by the fit portion 210 of the end flange 202. Namely, the end flange 202 is constituted as a preassembly state where it holds the seal member 300 in the stage before the assembly state.

Figure 10A:
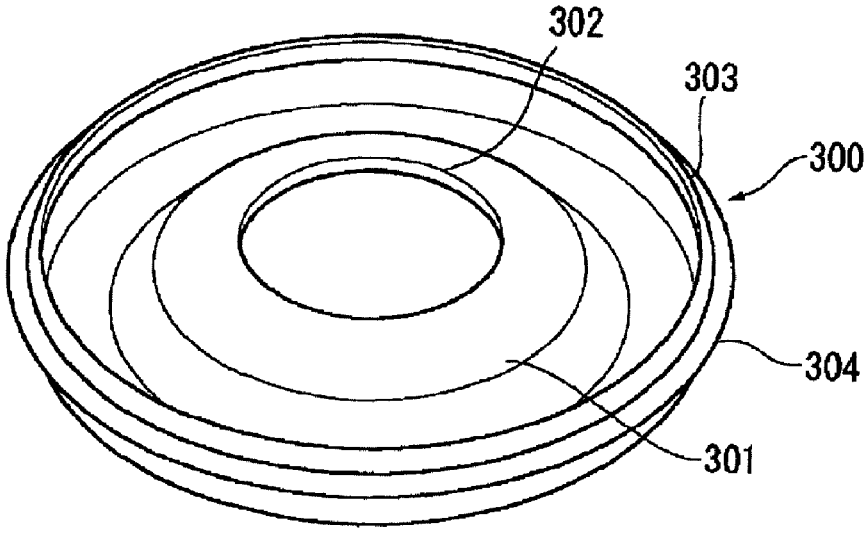
FIG. 10A is a perspective view showing the details of a seal member used in the first embodiment.
Figure 10B:
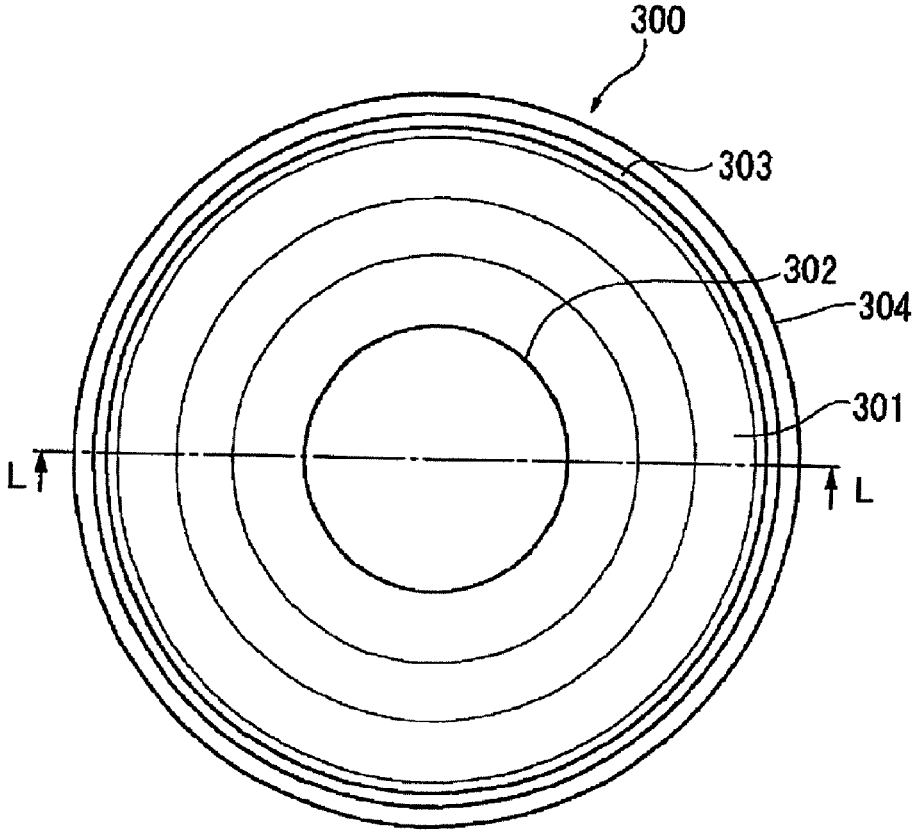
FIG. 10B is a plan view of the seal member.
Figure 11A:
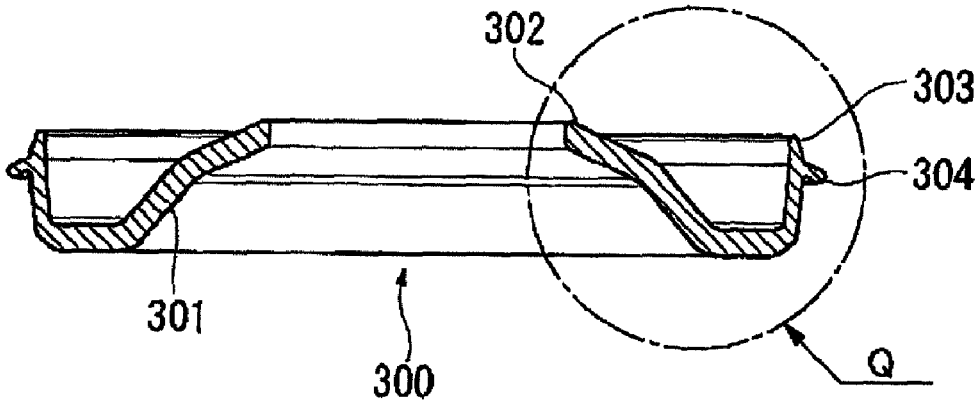
FIG. 11A is an explanatory view of a cross section taken along an L-L line in FIG. 10B.

The seal member 300 is integrally formed of elastic material such as polyethylene or polypropylene, and includes, as shown in FIGS. 10A and B, FIGS. 11A and B, and FIG. 12, an annular main body portion 301 which is accommodated in the fit portion 210 and which the rotational shaft of the agitator 205 (in this example, the hitch portion 212 as the coupling member which supports the rotational shaft portion 205*a* of the agitator 205) penetrates. At an inner edge and an outer edge of this annular main body portion 301, seal abutment pieces (inner edge seal abutment piece and outer edge seal abutment piece) 302, 303 which abut on the bottom wall 213 of the fit portion 210 are formed; and at a peripheral edge of the annular main body portion 301, a seal abutment piece (peripheral edge seal abutment piece) 304 which abuts on the peripheral wall 214 of the fit portion 210 is formed.

Here, assuming that the seal member 300 is held by the fit portion 210 of the end flange 202 under the condition where the end flange 202 is put in the preassembly state, as shown in FIGS. 11A and B, pushing and pulling directional dimensions $a_1$ and $a_2$ of the seal abutment pieces 302 and 303 in relation to the end flange 202, which start from a base portion of the peripheral seal abutment piece 304, are set so as to satisfy a relation of $a_1>a_2$.

(Positioning Mechanism)

Figure 8:
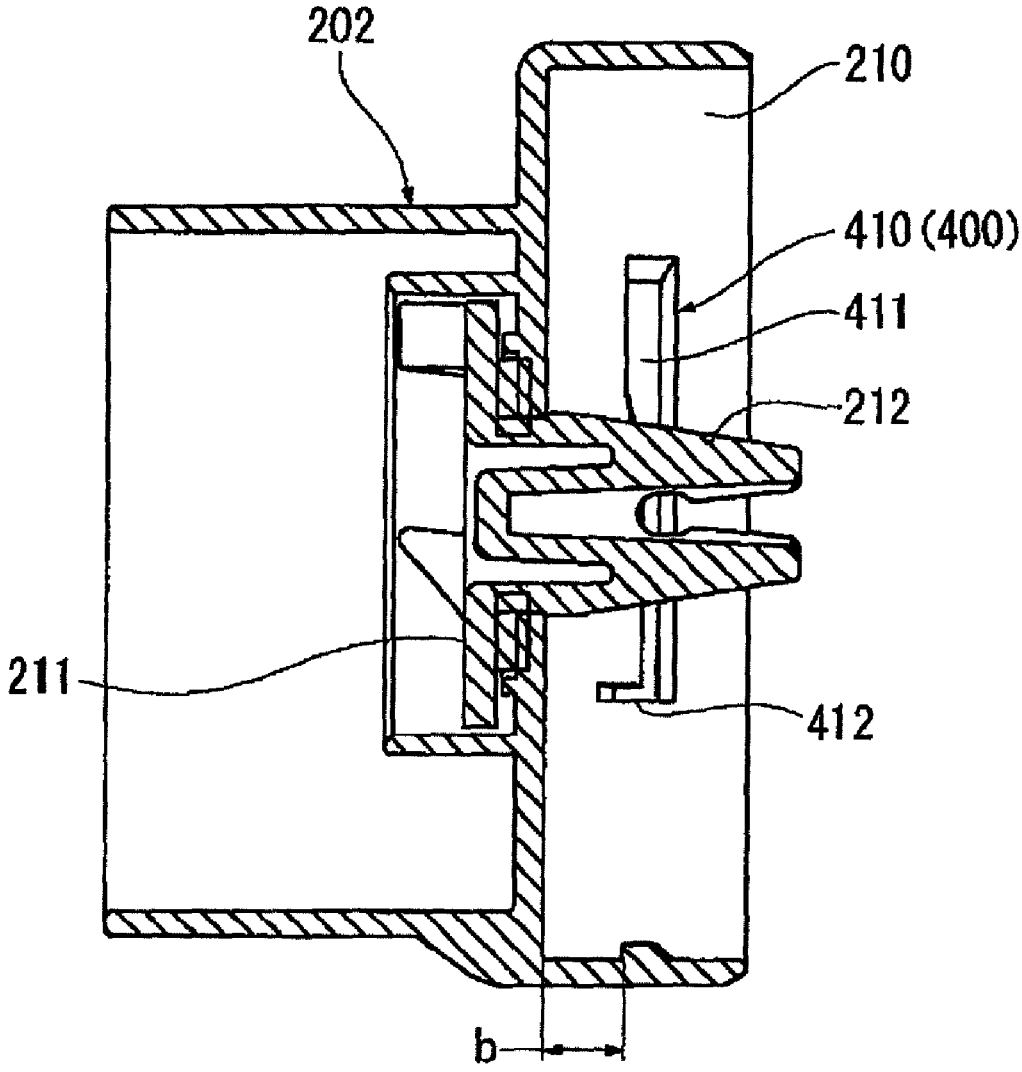
FIG. 8 is an explanatory view showing the details of a cross section of the cap member (end flange) used in the first embodiment.

In the embodiment, as shown in FIG. 8, between the tip cylindrical portion 200*a* of the container main body 200 and the fit portion 210 of the end flange 202, there is provided a positioning mechanism 400 which, when the end flange 202 is attached to the tip cylindrical portion 200*a* of the container main body 200 in the attachment position, positions their end flange 202 and tip cylindrical portion 200*a*.

This positioning mechanism 400 includes a positioned protrusion 410 which is projectingly provided on the peripheral wall 214 of the fit portion 210 of the end flange 202 and used in order to position the end flange 202 in a predetermined position of the tip cylindrical portion 200*a* of the container main body 200, and a positioning protrusion 420 (refer to FIG. 9) which is projectingly provided on the outer peripheral wall of the tip cylindrical portion 200*a* of the container main body 200 and abuts on the positioned protrusion 410 to position the positioned protrusion 410 in a predetermined positioning position. These positioned protrusion 410 and positioning protrusion 420 may be integrally formed respectively with the end flange 202 and the container main body 200, or another body may be secured respectively to the end flange 202 and the container main body 200 as the protrusions 410 and 420.

In the embodiment, the plural positioned protrusions 410, as shown in FIG. 8, are provided on the peripheral wall 214 of the fit portion 210 of the end flange 202. Each positioned protrusion 410 includes a guide projection strip 411 extending along the rotational direction of the end flange 202, and a rotation stopping projection 412 extending from one end side of this guide projection strip 411 toward the pushing direction of the end flange 202.

On the other hand, the plural positioning protrusions 420, as shown in FIG. 9, are provided correspondingly to the plural positioned protrusions 410. Each positioning protrusion 420 includes a block wall 421 which abuts on the guide projection strip 411 and rotation stopping projection 412 of the positioned protrusion 410 thereby to be blocked.

Here, regarding the layout of the positioned protrusion 410 and the positioning protrusion 420, as shown in FIGS. 8 and 9, a dimension between the bottom wall 213 of the fit portion 210 and a positioned surface of the guide projection strip 411 of the positioned protrusion 410 provided for the fit portion 210 of the end flange 202 is taken as b, and a dimension from the leading end of the tip cylindrical portion 200*a* of the container main body 200 to a positioning surface of the positioning protrusion 420 corresponding to the positioned surface of the guide projection strip 411 of the positioned protrusion 410 is taken as c.

(Attachment State of Seal Member in Embodiment)

(1) Preassembly State

Figure 11B:
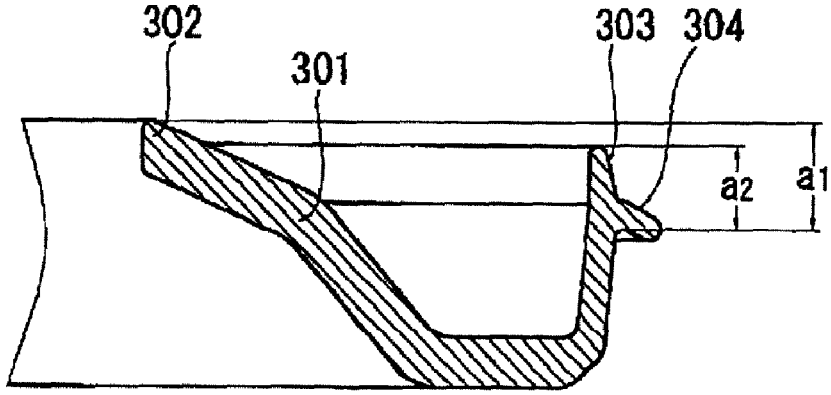
FIG. 11B is an enlarged view showing the details of a portion Q in FIG. 11A.
Figure 12B:
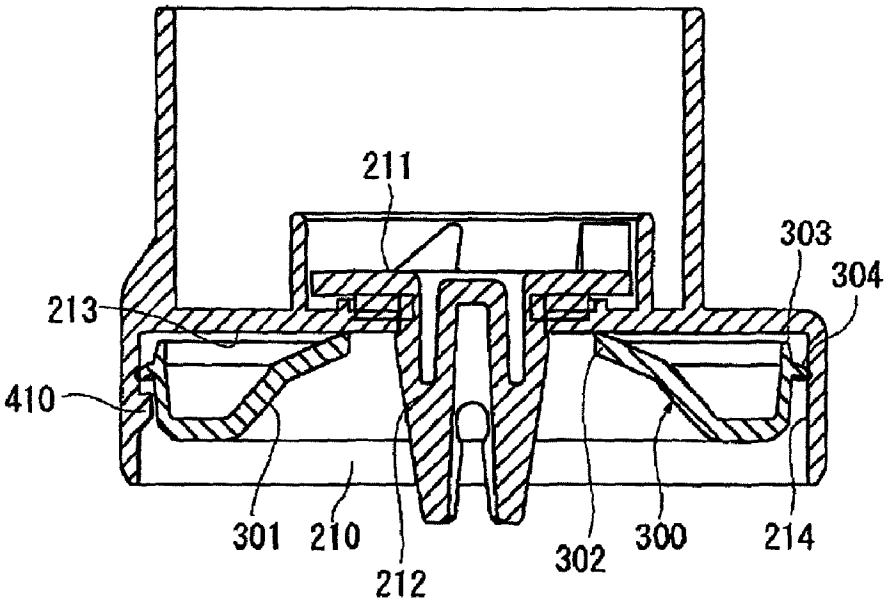
FIG. 12B is an explanatory view of a cross section taken along a ling P-P in FIG. 12A.
Figure 12A:
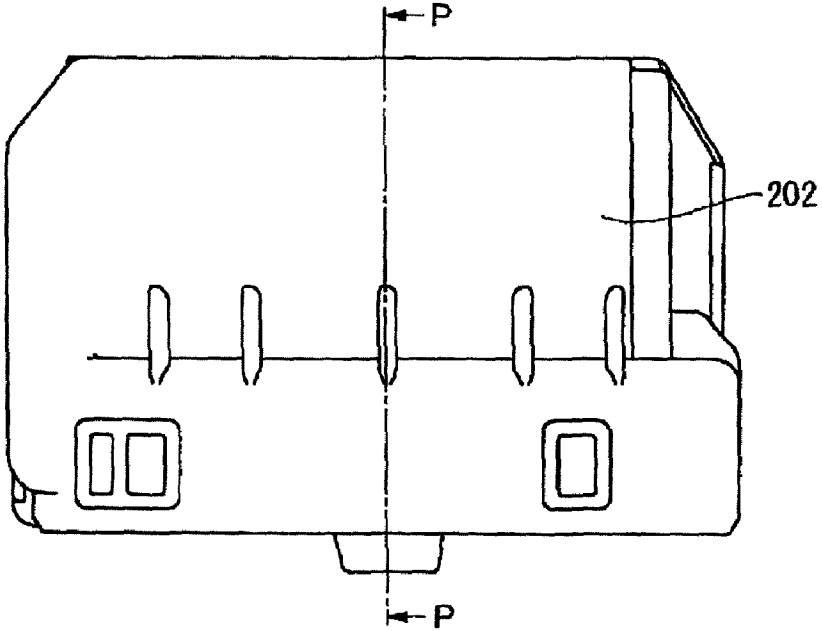
FIG. 12A is an explanatory view showing the cap member in a preassembly state to the developer accommodating container according to the first embodiment where the seal member is held.

As shown in FIGS. 12A and B, in case that the end flange 202 is in the preassembly state, the seal member 300 is held by the fit portion 210 of the end flange 202. In this time, a relation between the dimension $a_1$ of the inner edge seal abutment piece 302 and the dimension $a_2$ of the outer edge seal abutment piece 303 of the seal member 300 is set to the relation shown in FIG. 11B. Therefore, the inner edge seal abutment piece 302 of the seal member 300 is arranged in contact with the bottom wall 213 of the fit portion 210, but the outer edge seal abutment piece 303 of the seal member 300 is arranged in non-contact with the bottom wall 213 of the fit portion 210. The peripheral edge seal abutment piece 304 of the seal member 300 is arranged in contact with the peripheral wall 214 of the fit portion 210.

Accordingly, in case that the end flange 202 is put in the preassembly state, since the outer edge seal abutment piece 303 of the seal member 300 is in the non-contact state with the bottom wall 213 of the fit portion 210, even if the seal member 300 is held in the preassembly state for a long period, the outer edge seal abutment piece 303 does not deform elastically. Therefore, compared with the case where the seal member 300 is stored for a long period in a state where the outer edge seal abutment piece 303 is left deforming elastically, the shape deterioration that the shape of the outer edge seal abutment piece 303 deforms does not appear.

Further, in the embodiment, as shown in FIG. 12B, the seal member 300 in the preassembly state is held by the fit portion 210 of the end flange 202, and the positioned protrusion 410 of the positioning mechanism 400 functions as a retaining stopper for the seal member 300.

(2) Assembly State

Figure 13:
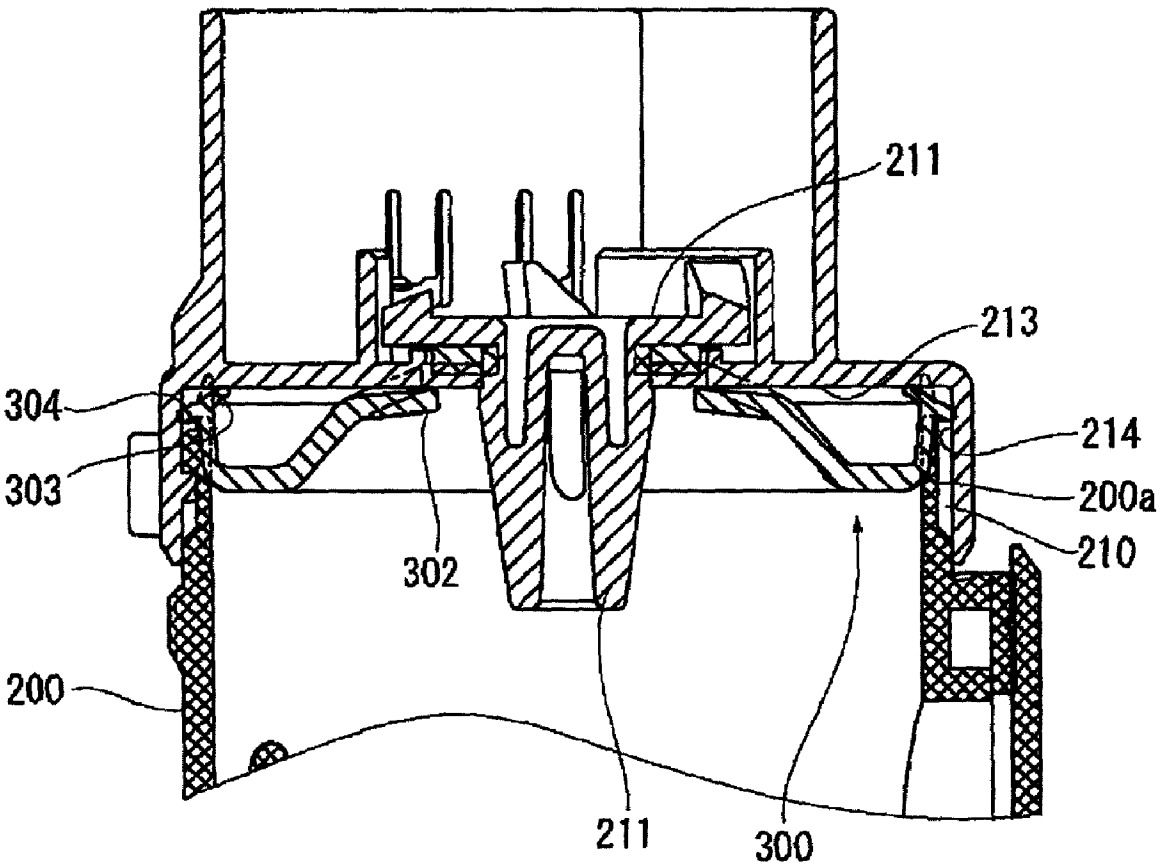
FIG. 13 is an explanatory view showing action of the seal member in an assembly state where the cap member has attached to the container main body of the developer accommodating container according to the first embodiment.

Next, an attachment state of the seal member 300 in an assembly state where the end flange 202 is attached to the tip cylindrical portion 200*a* of the container main body 200 will be described referring to FIG. 13.

In the embodiment, the relation (refer to FIG. 11) in dimensions $a_1$ and $a_2$ between the inner edge seal abutment piece 302 of the seal member 300 and the outer edge seal abutment piece 303 of the seal member 300, and the relation in dimensions b and c (refer to FIGS. 8 and 9) between the positioned protrusion 410 and the positioning protrusion 420 satisfy relations of $a_1>b-c$, $a_2>b-c$, and $a_1>a_2$.

In this time, 'b−c' means distance from the bottom wall 213 of the fit portion 210 of the end flange 202 to the tip cylindrical portion 200*a* of the container main body 200. The seal member 300 held by the fit portion 210 is pressed by the tip cylindrical portion 200*a* of the container main body 200 up to the distance 'b−c'. Therefore, in the preassembly state, the inner edge seal abutment piece 302 having the dimension $a_1$ and the outer edge seal abutment piece 303 having the dimension $a_2$ are arranged, in a state where they elastically deform up to the distance 'b−c', in contact with the bottom wall 213 of the fit portion 210.

Under this state, both of the seal abutment pieces 302 to 304 of the seal 300 are arranged in elastic contact with the bottom wall 213 or the peripheral wall 214 of the fit portion 210. Therefore, between the seal abutment pieces 302 to 304 and the wall surfaces of the fit portion 210, a triple sealing portion is obtained due to the elastic contact, and the slide resistance accompanied by the elastic contact of the seal abutment pieces 302 to 304 is obtained.

Therefore, even if the user rotation-operates the end flange 202 under the assembly state in error, since the slide resistance by the seal abutment pieces 302 to 304 act, the end flange 202 never rotate in error and there is no fear that the end flange 202 is opened in error.

(Attachment State of Seal Member in Compared Example)

Next, using a seal member 300' in a compared example in place of the seal member 300 used in this embodiment, attachment states of the seal member 300' in the preassemble state and in the assemble state will be described.

Figure 14B:
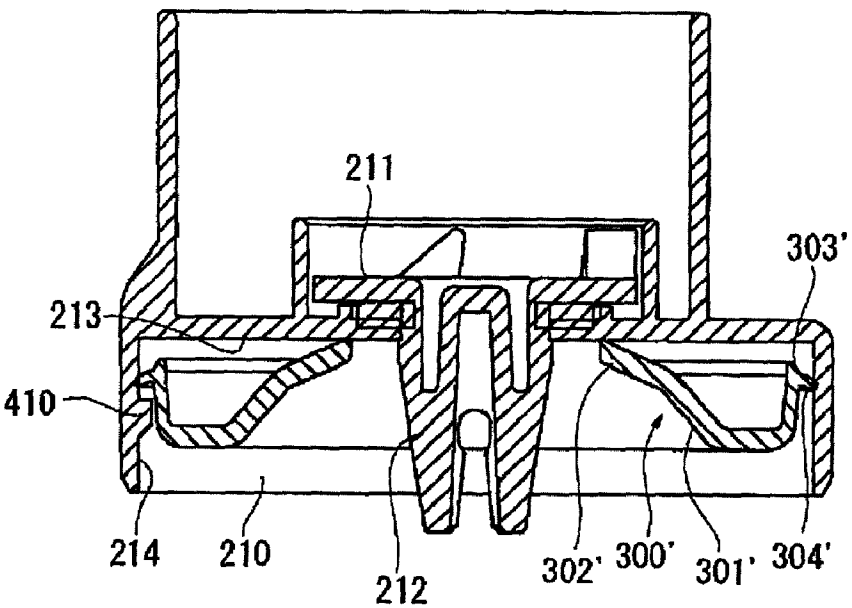
FIG. 14B is an explanatory view of a cross section taken along a ling P-P in FIG. 14A.
Figure 14A:
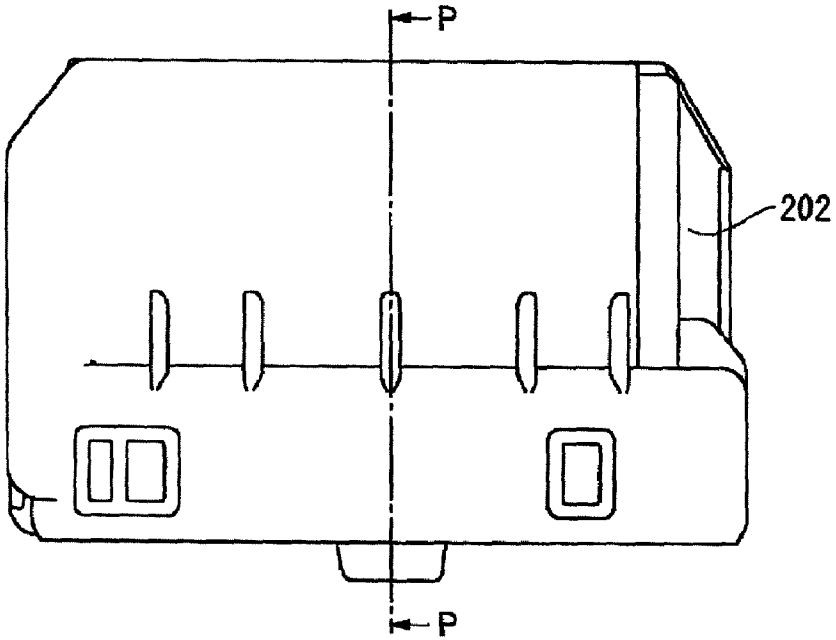
FIG. 14A is an explanatory view showing the cap member in a preassembly state to a developer accommodating container according to a compared example where the seal member is held.

In the compared example, the seal member 300', as shown in FIGS. 14A and 14B, includes an annular main body portion 301'accommodated in a fit portion 210 of an end flange 202. At an inner edge of this annular main body portion 301', an inner edge seal abutment piece 302' which comes into elastic contact with a bottom wall 213 of the fit portion 210 is provided; at an outer edge thereof, a protrusion piece (rib) 303' for pressing the seal member 300'deep into the fit portion 210 is provided; and at a peripheral edge of the annular main body portion 301', a peripheral edge seal abutment piece 304' which comes into elastic contact with a peripheral wall 214 of the fit portion 210 is provided.

Here, similarly to in the first embodiment, a relation in dimensions $a_1$ and $a_2$ between the inner edge seal abutment piece 302'of the seal member 300' and the protrusion piece 303' thereof (Though the protrusion piece 303' is functionally different from the outer edge seal abutment piece 303 in the first embodiment, the dimension of the protrusion piece 303' corresponds to the dimension of the outer edge seal abutment piece 303 as shown in FIG. 11.), and relation in dimensions b and c (refer to FIGS. 8 and 9) between a positioned protrusion 410 and a positioning protrusion 420 are set so as to satisfy relations of $a_1>b-c$, $a_2\leqq b-c$, and $a_1>a_2$.

(1) Preassembly State

As shown in FIGS. 14A and 14B, in case that the end flange 202 is in the preassembly state, the seal member 300' is held by the fit portion 210 of the end flange 202. In this time, the relation in dimensions $a_1$ and $a_2$ between the inner edge seal abutment piece 302' and the protrusion piece 303' of the seal member 300' is set to $a_1>a_2$. Therefore, the inner edge seal abutment piece 302' of the seal member 300' is arranged in contact with the bottom wall 213 of the fit portion 210, but the protrusion piece 303' is arranged in non-contact with the bottom wall 213 of the fit portion 210. The peripheral edge seal abutment piece 304' of the seal member 300' is arranged in contact with the peripheral wall 214 of the fit portion 210.

Accordingly, in this compared example, the attachment state of the seal member 300' is substantially similar to the attachment state in the first embodiment.

(2) Assembly State

Figure 15:
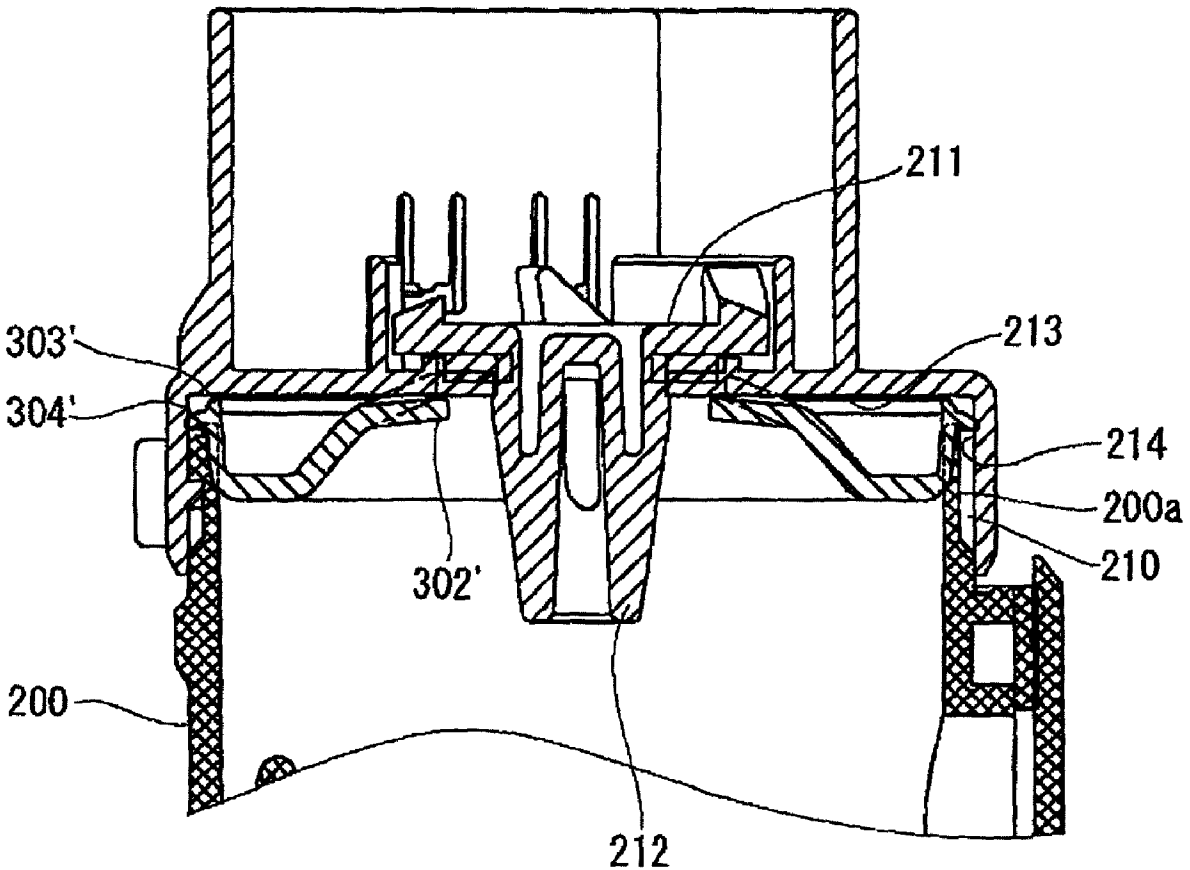
FIG. 15 is an explanatory view showing action of the seal member in an assembly state where the cap member has attached to the container main body of the developer accommodating container according to the compared example.

Next, an attachment state of the seal member 300' in the assembly state where the end flange 202 is attached to a tip cylindrical portion 200*a* of a container main body 200 will be described referring to FIG. 15.

Each dimensional relation ($a_1$, $a_2$, b and c) of the seal member 300' in this case is the above-mentioned relation. A reference character 'b−c' means distance from the bottom wall 213 of the fit portion 210 of the end flange 202 to the tip cylindrical portion 200*a* of the container main body 200. The seal member 300' held by the fit portion 210 is pressed by the tip cylindrical portion 200*a* of the container main body 200 up to the distance 'b−c'. Therefore, in the preassembly state, the inner edge seal abutment piece 302' having the dimension $a_1$ is arranged in contact with the bottom wall 213 of the fit portion 210 in a state where the piece 302' elastically deforms up to the distance 'b−c'.

To the contrary, since the protrusion piece 303' of the seal member 300' satisfies the relation of $a_2 \leqq b-c$, the protrusion piece 303' is arranged in non-contact with the bottom wall 213 of the fit portion 210, or approaches the bottom wall 213 so as to come into contact with the bottom wall 213 but does not deform elastically.

Therefore, it is not said that this protrusion piece 303' is arranged in elastic contact with the bottom wall 213 of the fit portion 210, so that a seal portion is not obtained at this protrusion piece 303' portion. Further, between the protrusion piece 303' and the bottom wall 213 of the fit portion 210, the slide resistance by their contact is not obtained.

The peripheral edge seal abutment piece 304' is arranged in elastic contact with the peripheral wall 214 of the fit portion 210.

Thus, in this compared example, since the protrusion piece 303' does not act as the seal abutment piece 303 as in the first embodiment, in case that the user rotation-operates the end flange 202 under the assembly state in error, the slide resistance by the seal abutment pieces 302' and 304' act, but the slide resistance by the protrusion piece 303' is not obtained. Therefore, compared with the case in the first embodiment, there is fear that the end flange 202 rotates in error and the end flange 202 is opened in error.

(Shutter)

Further, in the embodiment, in the peripheral wall of the container main body 200 located in the vicinity of the end flange 202, a discharge opening 220 is provided, and this discharge opening 220 is provided with a shutter 230 as an opening and closing mechanism for opening and closing the opening 220.

Figure 16:
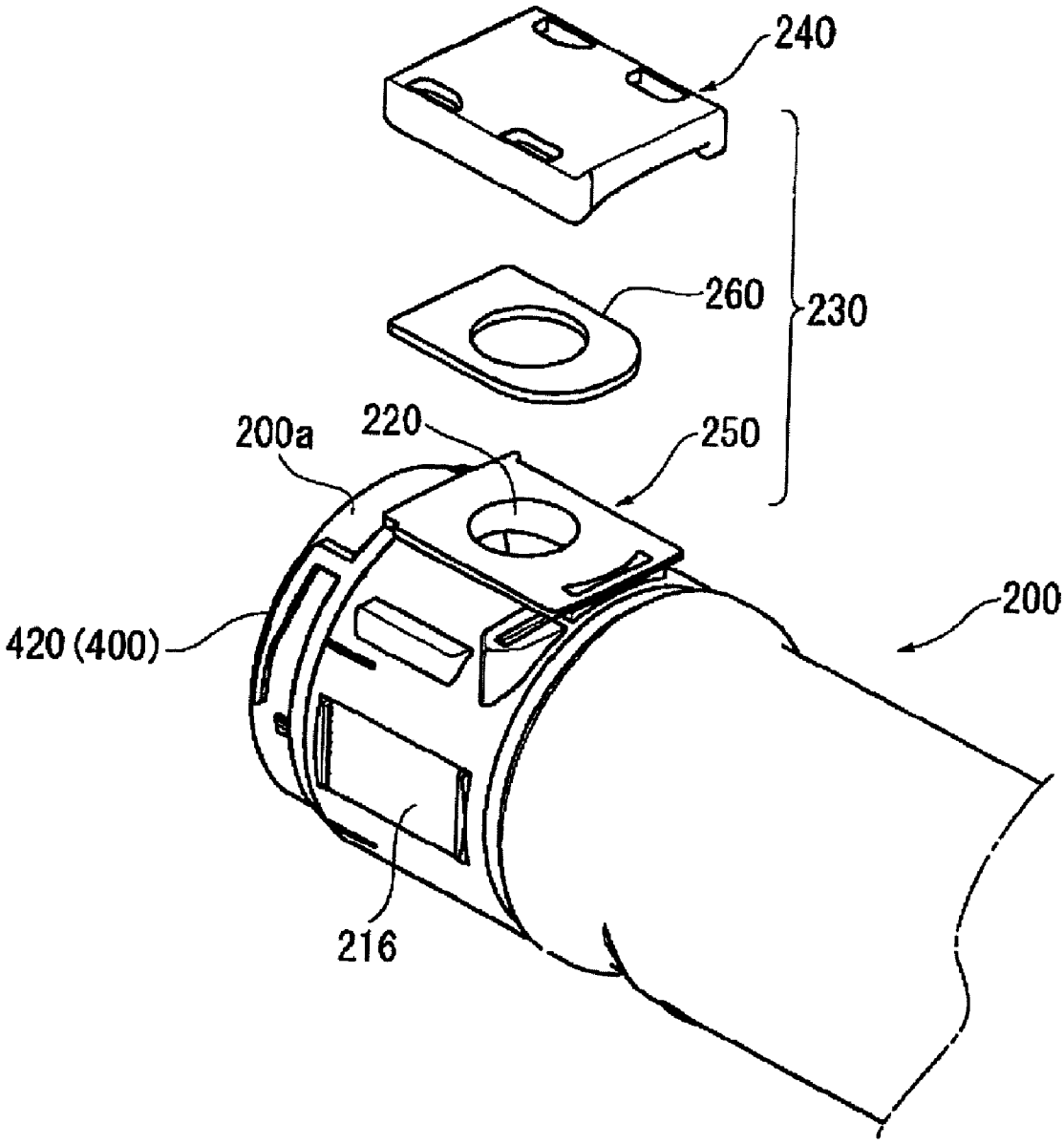
FIG. 16 is an exploded perspective view showing a shutter (opening and closing lid, and lid holding frame) used in the first embodiment.
Figure 17A:
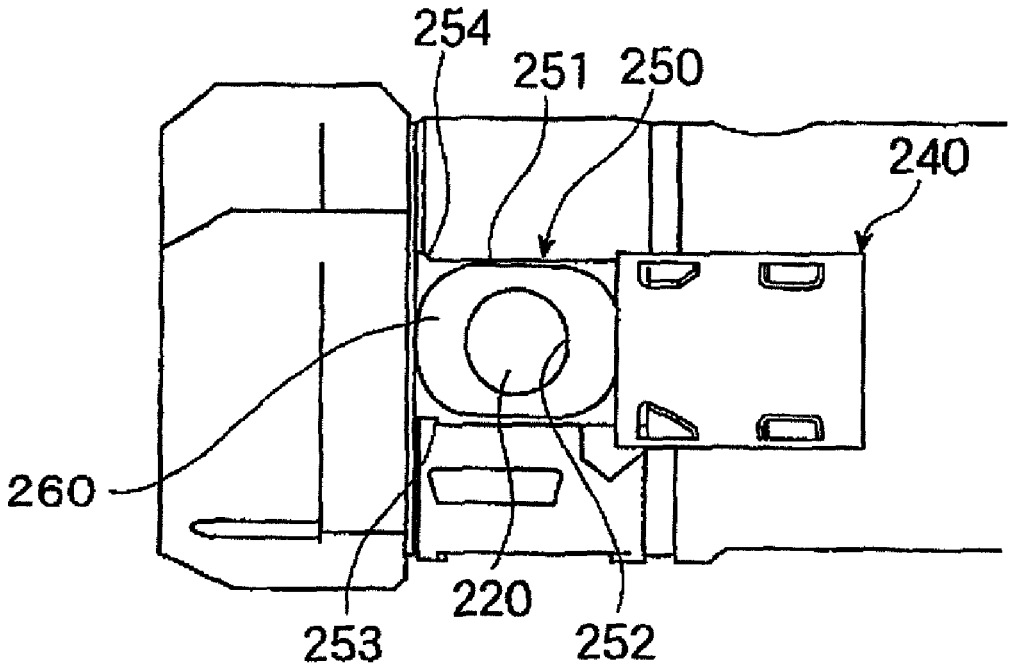
FIG. 17A is a plan view of the shutter used in the first embodiment.

In the embodiment, the shutter 230, as shown in FIGS. 16 and 17A, includes an opening and closing lid 240 for covering the discharge opening 220, and a lid holding frame 250 for holding this opening and closing lid 240 movably in the opening-and-closing operational direction.

(Opening and Closing Lid)

Figure 17B:
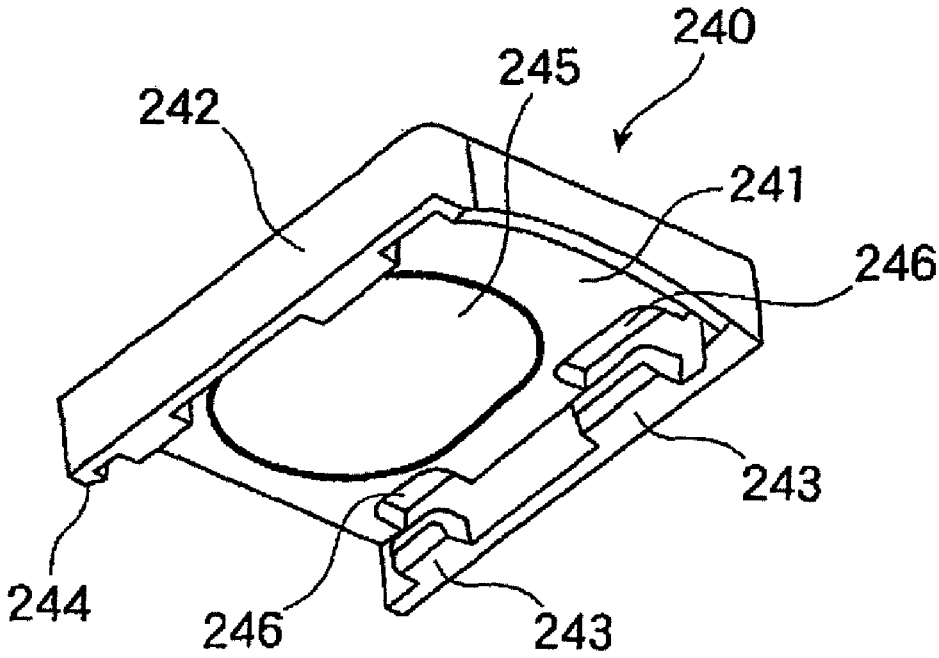
FIG. 17B is a perspective view showing the details of the opening and closing lid.

The opening and closing lid 240, as shown in FIG. 17B, includes a substantially rectangular plate-shaped lid main body 241 having the larger area than the area of the discharge opening 220; side wall portions 242 formed at three sides in other directions except one of the opening-and-closing operational directions of this lid main body 241; the appropriate number of holding arms 243 formed at the side wall portions 242 located on both sides in the width direction orthogonal to the opening-and-closing operational direction (two holding arms 243 spaced in the opening-and-closing operational direction are formed on each of both sides), which protrude inward and hold the lid holding frame 250 so as to embrace the frame 250; a hitch pawl 244 formed as a stopper at an opening end of the side wall portion 242 located on one side in the width direction of the lid main body 241; and an elastic seal material 245 stuck onto a surface on the lid holding frame 250 side of the lid main body 241, which comes into elastic contact with the lid holding frame 250 surface.

In this example, at the lid main body 241 portions corresponding to the holding arms 243, hole portions 246 are provided, and this opening and closing lid 240 holds each of the both side edges of the lid holding frame 250 at three points by the two holding arms 243 and the lid main body 241 located between these holding arms 243 thereby to move stably along the both side edges of the lid holding frame 250.

(Lid Holding Frame)

In the embodiment, the lid holding frame 250, as shown in FIG. 17A, includes a substantially rectangular plate-shaped frame main body 251; a through-hole 255 formed in a portion of this frame main body 251 corresponding to the discharge opening 220; a notch-shaped block portion 253 formed at one corner of an end edge of the frame main body 251 in a direction where the opening and closing lid 240 closes; and a position regulating projection 254 formed at a corner on the opposite side of the end edge of the frame main body 251, which protrudes in the width direction orthogonal to the opening-and-closing operational direction.

Particularly, in the embodiment, a dimension between the both side edges in the width direction of the lid holding frame 250 is set narrower a little than a dimension between the both side wall portions 242 in the width direction of the opening and closing lid 240.

Figure 18:
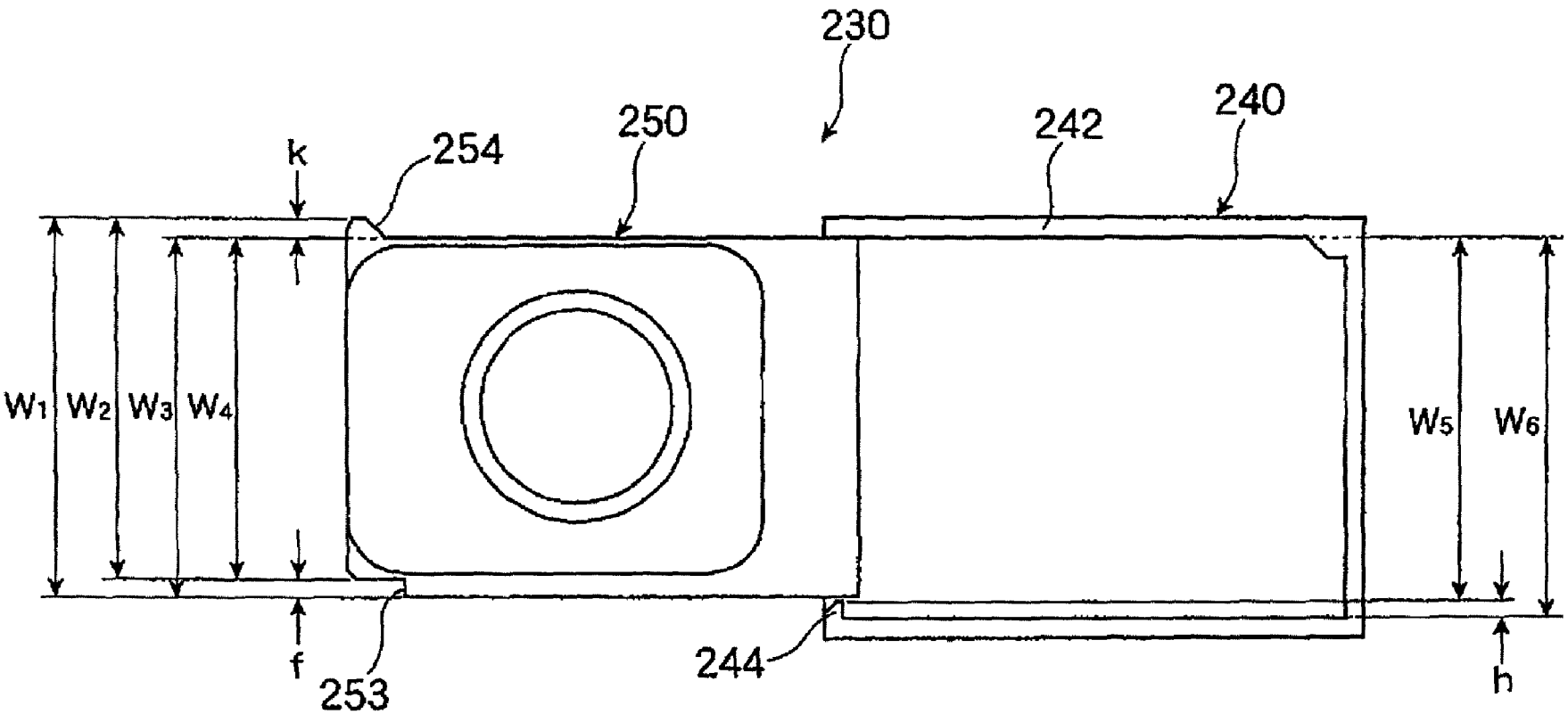
FIG. 18 is an explanatory view showing the details of dimensional relations when the shutter (opening and closing lid and lid holding frame) used in the first embodiment is opened and closed.

Further, in the embodiment, as shown in FIG. 18, a protrusion dimension K of the position regulating projection 254 from the basis position of the width direction both side edges of the lid holding frame 250 is set larger than a width direction dimension of the block portion 253. In case that the side wall portions 242 in the width direction of the opening and closing lid 240 abut on the basis position of the width direction side edge of the lid holding frame 250, the opening and closing lid 240 moves in the width direction by the protrusion dimension k of the position regulating projection 254, so that the hitch pawl 244 of the opening and closing lid 240 enters the non-contact state with the block portion 253 and is kept in a positional relation where restraint from the block portion 253 is released.

In FIG. 16, reference numeral 260 is a seal plate formed of, for example, elastic rubber, which is provided between the opening and closing lid 240 and the lid holding frame 250 to provide a hermetical seal between them, and previously secured onto the frame main body 251.

Dimensional relations for performing the opening and closing operation of the shutter 230 (opening and closing lid 240 and lid holding frame 250) are collectively shown in FIG. 18.

In FIG. 18, reference characters w1 to w6 and f, h, and k show the following dimensions.

w1: maximum width up to position regulating projection leading end of lid holding frame w2: width from position regulating projection leading end of lid holding frame to block portion w3: width between both side portions of lid holding frame except position regulating projection w4: width from one side portion of lid holding frame except position regulating projection to block portion w5: width from one side wall inner surface in width direction of opening and closing lid to stopper portion w6: maximum width between both side walls in width direction of opening and closing lid except stopper portion f: block length of block portion h: hitching length of stopper portion (hitch pawl)

k: protrusion size of position regulating projection

In the figure, first, on investigation of conditions that the opening and closing lid 240 fits to the lid holding frame 250, when w2>w5 and w3>w5, the lid 240 does not fit thereto. Therefore, it is necessary to satisfy w5−w2>0 and w5−w3>0.

Next, when w1>w5, even in case that the opening and closing lid 240 moves along the leading end position of the position regulating projection 254, the pitch pawl 244 as the stopper portion and the block portion 253 do not overlap each other in the opening and closing direction, so that there is fear that they do not function as the movement restraining means. Therefore, it is necessary to satisfy w1−w5>0.

On investigation of the block length f (w1−w2) of the block portion 253, it is necessary that f is larger than clearance of w5−w2, i.e., that f−(w5−w2)>0 or f>w5−w2.

Similarly, on investigation of the protrusion size k (w1−w3) of the position regulating projection 254, it is necessary that k is larger than clearance of w5−w3, i.e., that k−(w5−w3)>0 or k>w5−w3.

Further, in case that the hitch length h (w6−w5) of the hitch pawl 244 as the stopper portion is short, w1 becomes larger than w6 (w1>w6), so that the lid 240 does not fit to the frame 250. Therefore, it is necessary that w6−w1>0.

At this time, it is necessary that h is larger than clearance of w6−w1, i.e., that h−(w6−w1)>0 or h>w6−w1.

(Operation Process of Shutter)

In the embodiment, the shutter 230 passes through an operation process as shown in FIGS. 19 and 20.

(1) Shutter Closing

Shutter closing means a state where the opening and closing lid 240 is located in a closed position where it closes completely the discharge opening 220.

Figure 19B:
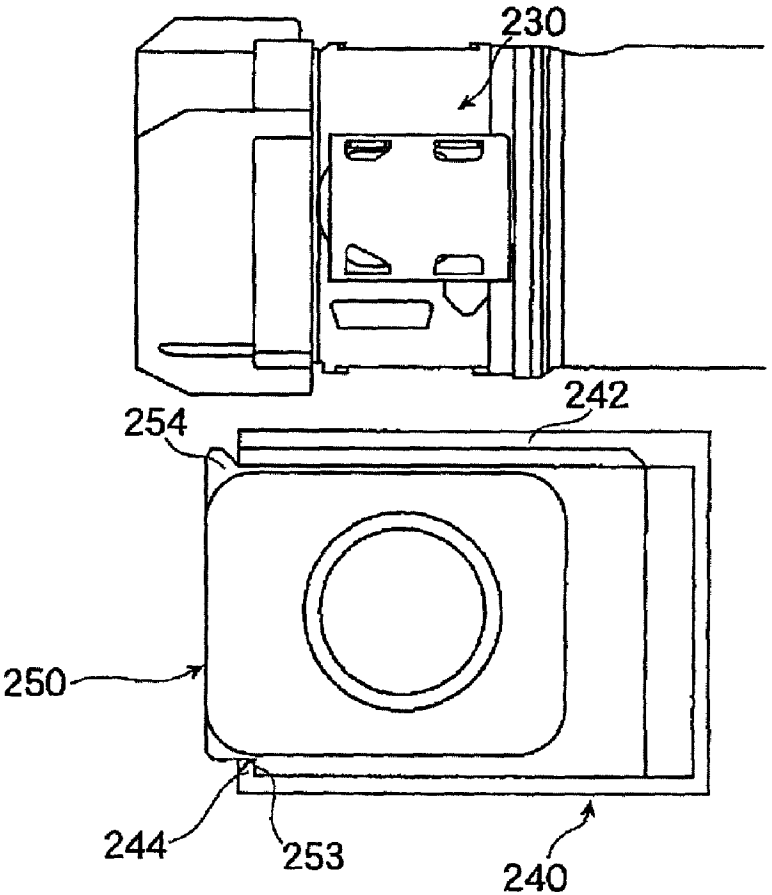
FIG. 19B is an explanatory view showing an operation process of the shutter put in a lock state.
Figure 19A:
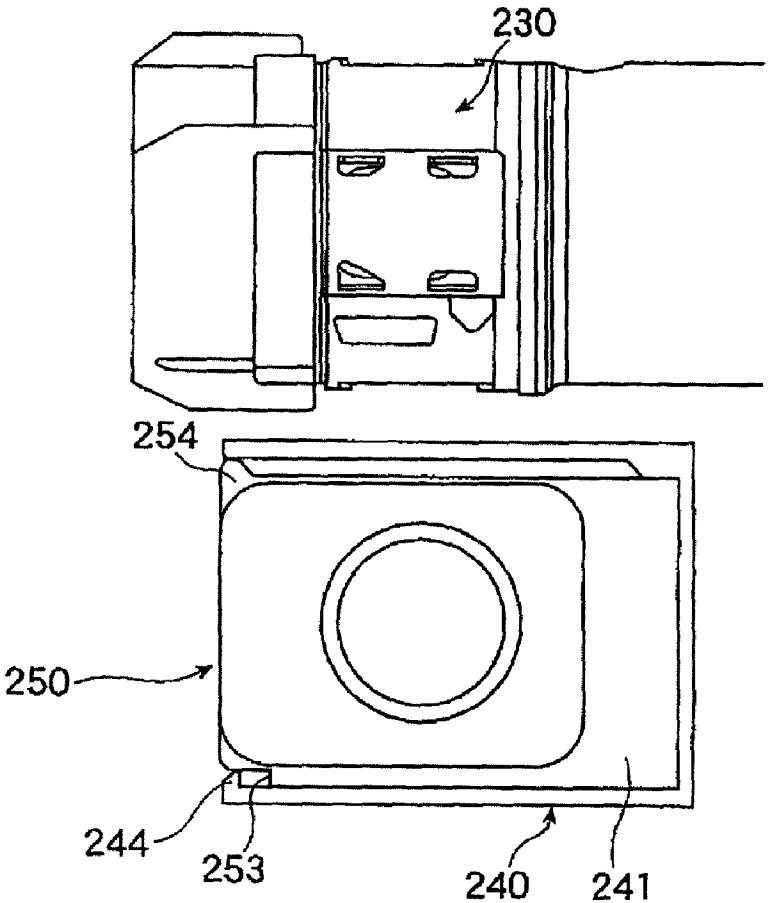
FIG. 19A is an explanatory view showing an operation process of the shutter located in a closed position.

At this time, as shown in FIG. 19A, the side wall portion 242 located in the opening-and-closing operational direction of the opening and closing lid 240 abuts on one end portion in the opening-and-closing operational direction of the lid holding frame 250, and the side wall portion 242 in the width direction of the opening and closing lid 240 is located in a position where it abuts on the leading end of the position regulating projection 254 of the lid holding frame 250.

(2) Shutter Lock

When the opening and closing lid 240 moves in the opening direction from the state of FIG. 19A, the opening and closing lid 240 moves while keeping the state in which its position is regulated by the position regulating projection 254, and the hitch pawl 244 of the opening and closing lid 240 abuts on the block portion 253 (refer to FIG. 19B).

At this time, since the movement of the opening and closing lid 240 is retrained in the position before its opening starts, the shutter 230 is locked in the opening-and-closing operational direction.

Therefore, even in case that the developer accommodating container 38, when attached, falls in error, or even in case that cushion materials such as styrene foam are not put on both sides into a cardboard box in the conveying time, there is hardly fear that the shutter opens in error.

(3) Shutter Unlock

As described in (2), in the shutter lock state, the width-directional side wall portion 242 of the opening and closing lid 240 moves to a position where it has passed through the position regulating projection 254 of the lid holding frame 250. Therefore, for the opening and closing lid 240, the movement to a direction where it comes close to the width-directional side edge of the lid holding frame 250 is permitted in relation to the width direction orthogonal to (crossing) the opening-and-closing operational direction.

Here, the opening and closing lid 240, till one side wall portion 242 in the width direction thereof abuts on the basis position of the width-directional side edge of the lid holding frame 250, moves along the width direction.

Figure 20B:
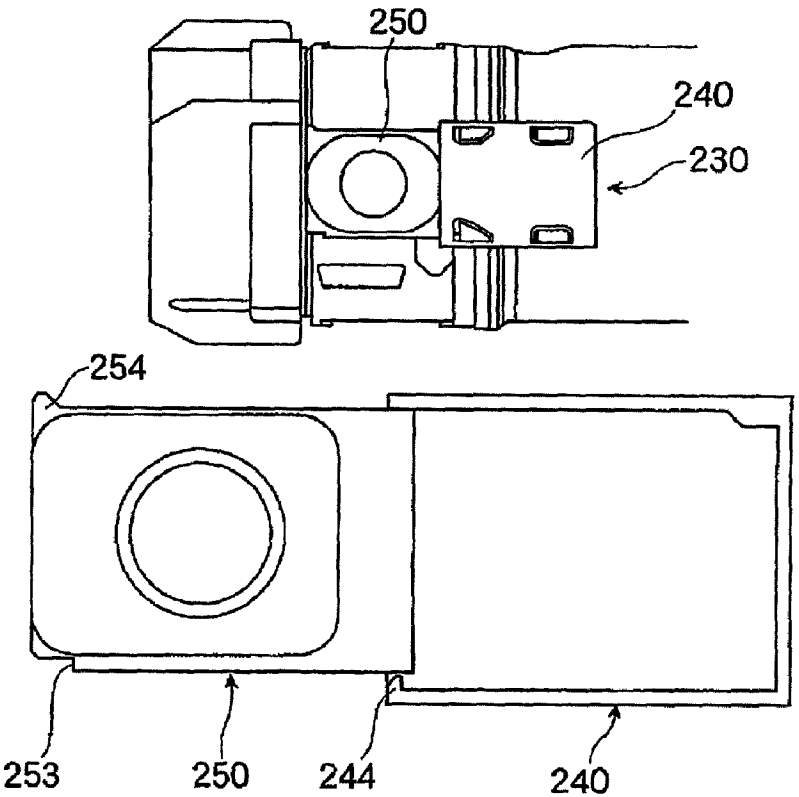
FIG. 20B is an explanatory view showing an operation process of the shutter located in an opened position.
Figure 20A:
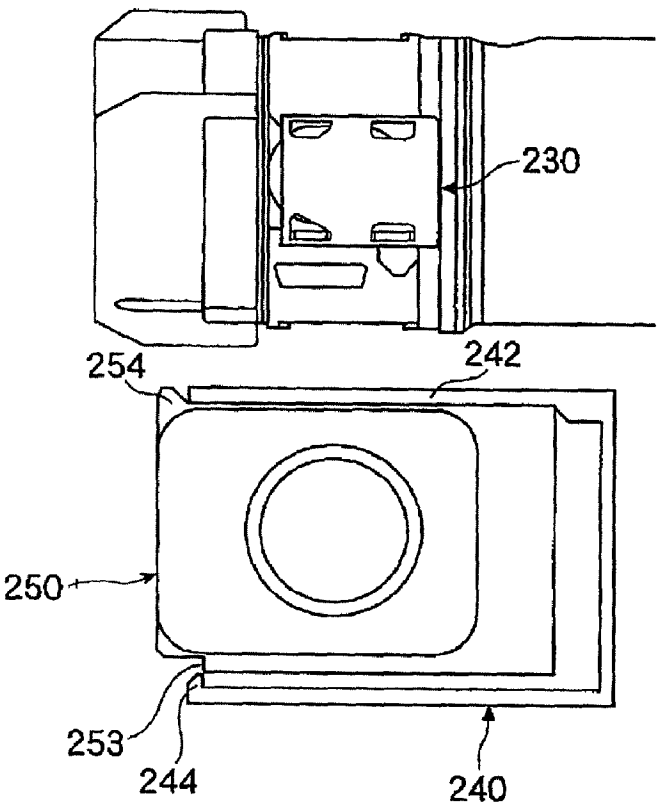
FIG. 20A is an explanatory view showing an operation process of the shutter put in a unlock state.

At this time, as shown in FIG. 20A, the hitch pawl 244 of the opening and closing lid 240 moves in a non-contact position with the block portion 253 of the lid holding frame 250. In result, the hitch pawl 244 is put in a movable state to the opening-and-closing operational direction of the opening and closing lid 240, and the restraint state of the opening and closing lid 240 by the block portion 253 and the hitch pawl 244 is released. Namely, the lock state of the shutter 230 in the opening-and-closing operational direction comes to be released, so that the shutter 230 becomes movable in the opening-and-closing operational direction.

(4) Shutter Opening

As described in (3), when the shutter 230 is unlocked, the movement in the opening-and-closing operational direction of the opening and closing lid 240 is permitted. Therefore, the opening and closing lid 240 moves to the opening position and opens completely the discharge opening 220.

At this time, the hitch pawl 244 of the opening and closing lid 240, as shown in FIG. 20B, moves along the width-directional side edge of the lid holding frame 250 in a non-contact state. Therefore, without detriment to the opening operation of the opening and closing lid 240, the opening and closing lid 240 moves up to its end position (opening position).

In this state, in the embodiment, since it is not necessary to apply the urging power by a spring or the like between the opening and closing lid 240 and the lid holding frame 250, the opening and closing lid 240 moves without particularly requiring the strong operation power in the opening-and-closing operational direction.

Further, though the developer accommodating container (toner cartridge) which is detachably attached to the electrophotographic type image forming apparatus, and accommodates the developer composed of powdery toner used in the development unit has been explained as an example, the invention is applicable to general accommodating containers which accommodate imaging material to be supplied to the image forming apparatus. For example, by enhancing airtightness around the shutter, the invention is applicable also to a developer accommodating container which accommodates liquid developer, and also to an ink accommodating container which accommodates ink to be supplied to an ink jet type image forming apparatus.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An accommodating container, which is detachably attached to a container receiver of an image forming apparatus housing and accommodates imaging material therein, the accommodating container comprising:

a container main body that has an opening at a part of the container main body, and accommodates the imaging material;

a cap member that is detachably attached to an opening edge of the container main body, and that envelopes an outer periphery wall of the container main body, and is pushed into the container main body up to an attachment position; and a seal member that is held by the cap member or the container main body, and that, when the cap member has been attached in the attachment position of the container main body, fills between the opening edge and the cap member and provides a seal between the opening edge and the cap member, wherein the seal member includes a plurality of seal abutment pieces that abut on a wall surface of the cap member or a wall surface of the container main body, and are elastically deformable, and at least one of the seal abutment pieces is arranged in non-contact with the wall surface of the cap member in a first state before the cap member is attached to the container main body, and is arranged in contact with the wall surface of the cap member in a second state where the cap member has been attached in an attachment position of the container main body.

2. The accommodating container as claimed in claim 1, wherein the cap member includes a fit portion having a bottom wall into which an opening edge cylindrical portion of the container main body is fit, and a holding portion for the seal member is formed in the fit portion.

3. The accommodating container as claimed in claim 2, further comprising a conveying member that is provided in the container main body, and rotates to convey the imaging material, wherein the seal member includes an annular main body portion that is accommodated into the fit portion of the cap member and to which a rotational shaft of the conveying member is penetrated, and the annular main body portion includes at least one sealing abutment piece which abuts on the bottom wall of the fit portion to which the rotational shaft of the conveying member is penetrated and on a peripheral wall of the fit portion surrounding the rotational shaft.

4. The accommodating container as claimed in claim 2, further comprising:

a conveying member that is provided in the container main body, and rotates to convey the imaging material, wherein the seal member comprises an annular main body portion that is accommodated in the fit portion of the cap member and to which a rotational shaft of the conveying member is penetrated, seal abutment pieces which abut on the bottom wall of the fit portion are formed on an inside and an outside of the annular main body portion seen from the rotational shaft of the conveying member, and the seal abutment piece located on the inside or the outside of the annular main body portion is arranged in non-contact with the bottom wall of the fit portion in the first state.

5. The accommodating container as claimed in claim 1, wherein the seal member has a plurality of seal abutment pieces extending in the pushing direction of the cap member, and satisfies the following formula (1):

$$X < Y \quad (1)$$

wherein X is a dimensional difference along the pushing direction of the cap member between the plurality of seal abutment pieces in the first state, and Y is a maximum elastic deformation volume of the seal member along the pushing direction when the cap member is in the second state.

6. An image forming apparatus comprising:

an image forming apparatus main body in which a container receiver is formed; and an accommodating container according to claim 1, the accommodating container being detachably attached to the container receiver of this image forming apparatus main body and accommodates imaging material therein.

7. An accommodating container, which is detachably attached to a container receiver of an image forming apparatus housing and accommodates imaging material therein, the accommodating container comprising:

a container main body that has an opening at a part of the container main body, and that accommodates imaging material;

a cap member that is detachably attached to an opening edge of the container main body, and that is pushed into the container main body up to an attachment position; and a seal member that is held by the cap member or the container main body, and that, when the cap member has been attached in the attachment position of the container main body, fills between the developer filling opening edge and the cap member and provides a seal between the developer filling opening edge and the cap member, wherein the seal member includes a plurality of seal abutment pieces that abut on a wall surface of the cap member or a wall surface of the container main body, and are elastically deformable, at least one of the seal abutment pieces is arranged in contact with the cap member in either of a first state before the cap member is attached to the container main body, and a second state where the cap member has been attached in the attachment position of the container main body, and at least another of the seal abutment pieces is arranged in non-contact with the cap member in the first state, and arranged in contact with the cap member in the second state.

8. The accommodating container as claimed in claim 7, wherein the cap member includes a fit portion having a bottom wall into which an opening edge cylindrical portion of the container main body is fit, and a holding portion for the seal member is formed in the fit portion.

9. The accommodating container as claimed in claim 8, further comprising a conveying member that is provided in the container main body, and rotates to convey the imaging material, wherein the seal member includes an annular main body portion that is accommodated into the fit portion of the cap member and to which a rotational shaft of the conveying member is penetrated, and the annular main body portion includes at least one sealing abutment piece which abuts on the bottom wall of the fit portion to which the rotational shaft of the conveying member is penetrated and on a peripheral wall of the fit portion surrounding the rotational shaft.

10. The accommodating container as claimed in claim 8, further comprising:

a conveying member that is provided in the container main body, and rotates to convey the imaging material, wherein the seal member comprises an annular main body portion that is accommodated in the fit portion of the cap member and to which a rotational shaft of the conveying member is penetrated, seal abutment pieces which abut on the bottom wall of the fit portion are formed on an inside and an outside of the annular main body portion seen from the rotational shaft of the conveying member, and the seal abutment piece located on the inside or the outside of the annular main body portion is arranged in non-contact with the bottom wall of the fit portion in the first state.

11. The accommodating container as claimed in claim 7, wherein the seal member has a plurality of seal abutment pieces extending in the pushing direction of the cap member, and satisfies the following formula (2):

$$X < Y \quad (2)$$

wherein X is a dimensional difference along the pushing direction of the cap member between the plurality of seal abutment pieces in the first state, and Y is a maximum elastic deformation volume of the seal member along the pushing direction when the cap member is in the second state.

12. An image forming apparatus comprising:

an image forming apparatus main body in which a container receiver is formed; and an accommodating container according to claim 7, the accommodating container being detachably attached to the container receiver of this image forming apparatus main body and accommodates imaging material therein.

13. An accommodating container, which is detachably attached to a container receiver of an image forming apparatus housing and accommodates imaging material therein, the accommodating container comprising:

a container main body that has an opening at a part of the container main body, and accommodates the imaging material;

a cap member that is detachably attached to an opening edge of the container main body, and that envelopes an outer periphery wall of the container main body, and is pushed into the container main body up to an attachment position; and a seal member that is held by the cap member or the container main body, and that, when the cap member has been attached in the attachment position of the container main body, fills between the opening edge and the cap member and provides a seal between the opening edge and the cap member, wherein the seal member includes a plurality of seal abutment pieces that abut on a wall surface of the cap member or a wall surface of the container main body, and are elastically deformable, and at least one of the seal abutment pieces is arranged in non-contact with the wall surface of the cap member in a first state before the cap member is attached to the container main body, and is arranged in contact with the wall surface of the cap member in a second state where the cap member has been attached in an attachment position of the container main body.

14. The accommodating container as claimed in claim 13, wherein the seal member comprises an annular main body portion that is accommodated in the fit portion of the cap member and to which a rotational shaft of the conveying member is penetrated, seal abutment pieces which abut on the bottom wall of the fit portion are formed on an inside and an outside of the annular main body portion seen from the rotational shaft of the conveying member, and the seal abutment piece located on the inside or the outside of the annular main body portion is arranged in non-contact with the bottom wall of the fit portion in the first state.

15. The accommodating container as claimed in claim 13, wherein the seal member has a plurality of seal abutment pieces extending in the pushing direction of the cap member, and satisfies the following formula (3):

$$X < Y \quad (3)$$

wherein X is a dimensional difference along the pushing direction of the cap member between the plurality of seal abutment pieces in the first state, and Y is a maximum elastic deformation volume of the seal member along the pushing direction when the cap member is in the second state.

16. An accommodating container, which is detachably attached to a container receiver of an image forming apparatus housing and accommodates imaging material therein, the accommodating container comprising:

a container main body that has an opening at a part of the container main body, and that accommodates imaging material;

a cap member that is detachably attached to an opening edge of the container main body, and that is pushed into the container main body up to an attachment position; and a seal member that is held by the cap member or the container main body, and that, when the cap member has been attached in the attachment position of the container main body, fills between the developer filling opening edge and the cap member and provides a seal between the developer filling opening edge and the cap member, wherein the seal member includes a plurality of seal abutment pieces that abut on a wall surface of the cap member or a wall surface of the container main body, and are elastically deformable, at least one of the seal abutment pieces is arranged in contact with the cap member in either of a first state after the cap member is detached from the container main body, and a second state where the cap member has been attached in the attachment position of the container main body, and at least another of the seal abutment pieces is arranged in non-contact with the cap member in the first state, and arranged in contact with the cap member in the second state.

17. The accommodating container as claimed in claim 16, wherein the seal member comprises an annular main body portion that is accommodated in the fit portion of the cap member and to which a rotational shaft of the conveying member is penetrated, seal abutment pieces which abut on the bottom wall of the fit portion are formed on an inside and an outside of the annular main body portion seen from the rotational shaft of the conveying member, and the seal abutment piece located on the inside or the outside of the annular main body portion is arranged in non-contact with the bottom wall of the fit portion in the first state.

18. The accommodating container as claimed in claim 16, wherein the seal member has a plurality of seal abutment pieces extending in the pushing direction of the cap member, and satisfies the following formula (4):

$$X < Y \quad (4)$$

wherein X is a dimensional difference along the pushing direction of the cap member between the plurality of seal abutment pieces in the first state, and Y is a maximum elastic deformation volume of the seal member along the pushing direction when the cap member is in the second state.

19. An accommodating container, which is detachably attached to a container receiver of an image forming apparatus housing and accommodates imaging material therein, the accommodating container comprising:

a container main body that has an opening at a part of the container main body, and that accommodates imaging material;

a cap member that is detachably attached to an opening edge of the container main body, and that is pushed into the container main body up to an attachment position; and a seal member that is held by the cap member or the container main body, and that, when the cap member has been attached in the attachment position of the container main body, fills between the developer filling opening edge and the cap member and provides a seal between the developer filling opening edge and the cap member, wherein the seal member includes a plurality of seal abutment pieces that abut on a wall surface of the cap member or a wall surface of the container main body, and are elastically deformable, at least one of the seal abutment pieces is arranged in contact with the container main body in either of a first state before the cap member is attached to the container main body, and a second state where the cap member has been attached in the attachment position of the container main body, and at least another of the seal abutment pieces is arranged in non-contact with the cap member or container main body in the first state, and arranged in contact with the cap member or container main body in the second state.

* * * * *